US009598946B2

(12) United States Patent
Shomody et al.

(10) Patent No.: US 9,598,946 B2
(45) Date of Patent: Mar. 21, 2017

(54) PROCESSING AND TRANSPORT OF STRANDED GAS TO CONSERVE RESOURCES AND REDUCE EMISSIONS

(71) Applicants: Ronald Grant Shomody, Calgary (CA); Gary Hart Palmer, Calgary (CA)

(72) Inventors: Ronald Grant Shomody, Calgary (CA); Gary Hart Palmer, Calgary (CA)

( * ) Notice: Subject to any disclaimer, the term of this patent is extended or adjusted under 35 U.S.C. 154(b) by 801 days.

(21) Appl. No.: 13/936,830

(22) Filed: Jul. 8, 2013

(65) Prior Publication Data

US 2015/0007981 A1 Jan. 8, 2015

(51) Int. Cl.

| | |
|---|---|
| ***E21B 43/00*** | (2006.01) |
| ***E21B 43/30*** | (2006.01) |
| ***E21B 43/34*** | (2006.01) |
| ***E21B 36/00*** | (2006.01) |
| ***E21B 41/00*** | (2006.01) |
| ***F25J 3/02*** | (2006.01) |
| *C10L 3/10* | (2006.01) |

(52) U.S. Cl.

CPC ..... *E21B 43/34* (2013.01); *E21B 36/00* (2013.01); *E21B 41/005* (2013.01); *F25J 3/0209* (2013.01); *F25J 3/0233* (2013.01); *F25J 3/0242* (2013.01); *F25J 3/0247* (2013.01); *C10L 3/103* (2013.01); *C10L 3/106* (2013.01); *F25J 2200/08* (2013.01); *F25J 2200/40* (2013.01); *F25J 2205/02* (2013.01); *F25J 2210/06* (2013.01); *F25J 2230/30* (2013.01); *F25J 2260/60* (2013.01)

(58) Field of Classification Search

CPC ..... E21B 36/00; E21B 41/005; E21B 43/34; C10L 3/103; C10L 3/106; F25J 2200/008; F25J 2200/40; F25J 2205/02; F25J 2210/06; F25J 2230/30; F25J 2260/60; F25J 3/0209; F25J 3/0233; F25J 3/0242; F25J 3/0247

See application file for complete search history.

(56) References Cited

U.S. PATENT DOCUMENTS 4,139,019 A * 2/1979 Bresie ..... F17C 5/002 137/351
4,479,546 A * 10/1984 Bresie ..... E21B 43/00 166/267

(Continued)

*Primary Examiner* — Daniel P Stephenson
(74) *Attorney, Agent, or Firm* — Adrian D. Battison; Ade & Company Inc.

(57) ABSTRACT

A method of gas production from a field containing natural gas processing particularly for transport of stranded gas to conserve resources and reduce emissions includes extracting gas a gas supply from a plurality of individual gas wells in the field and initially at the individual gas wells providing a recovery unit having a production capacity matching that of the well for carrying out liquid recovery from the gas supply and compression of the natural gas. When a production rate of the well declines to a low level, typically to about 20% of the original, the recovery unit is removed for redeployment either at a central plant or at other wells which are still at the high production and is substituted by a dehydration system and gas compressor arranged to fill portable pressure vessels typically on trucks for transporting the compressed natural gas to a main pipe line.

26 Claims, 12 Drawing Sheets

(56) References Cited

U.S. PATENT DOCUMENTS

| | | | | |
|---|---|---|---|---|
| 5,545,296 | A * | 8/1996 | Pathak | B01D 3/00 202/185.2 |
| 6,014,995 | A * | 1/2000 | Agnew | B60P 3/2245 137/208 |
| 6,755,255 | B2 * | 6/2004 | Wade | E21B 43/00 137/197 |
| 2006/0076076 | A1 * | 4/2006 | Darling | F17C 5/02 141/82 |
| 2008/0116115 | A1 * | 5/2008 | Shamsudin | C10G 5/04 208/344 |
| 2010/0071899 | A1 * | 3/2010 | Coquilleau | E21B 41/00 166/268 |
| 2010/0281775 | A1 * | 11/2010 | Logue | B01D 53/263 48/127.3 |
| 2011/0204064 | A1 * | 8/2011 | Crane | F17C 1/00 220/592 |
| 2012/0036888 | A1 * | 2/2012 | Vandor | F25J 1/0022 62/613 |
| 2012/0192580 | A1 * | 8/2012 | Santos | C10L 3/107 62/172 |
| 2013/0186132 | A1 * | 7/2013 | Banszky | F25J 3/08 62/618 |
| 2013/0306520 | A1 * | 11/2013 | Nikiforuk | C10L 3/101 208/187 |
| 2014/0366577 | A1 * | 12/2014 | Zubrin | F25J 3/0209 62/619 |
| 2015/0007981 | A1 * | 1/2015 | Shomody | E21B 36/00 166/245 |
| 2015/0368566 | A1 * | 12/2015 | Young | F25J 3/0209 700/273 |
| 2015/0376801 | A1 * | 12/2015 | Bairamijamal | B01D 53/002 204/257 |
| 2016/0129371 | A1 * | 5/2016 | Black | B01D 17/12 210/137 |

* cited by examiner

PROCESSING OF FLARE GAS AT CENTRAL PLANT FROM MULTIPLE FLARE GAS SOURCES

FIGURE 11
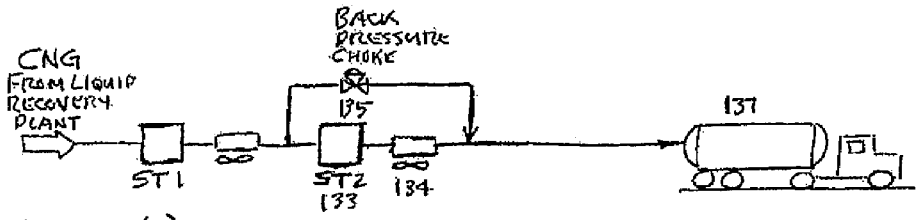
FIGURE 11 (A)
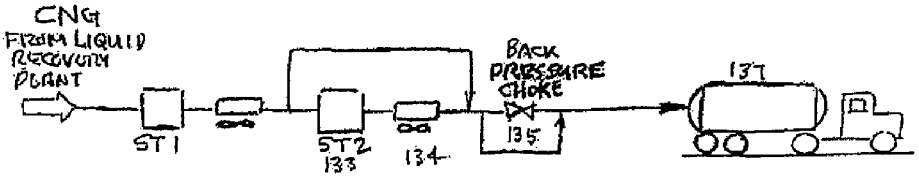
FIGURE 11 (B)
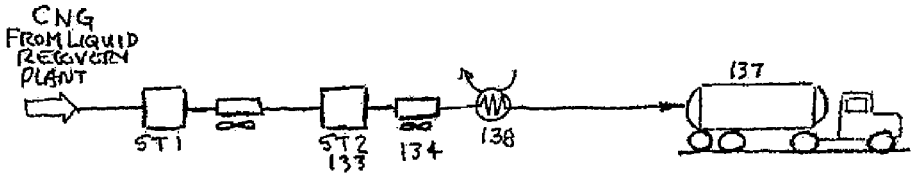
FIGURE 11 (C)
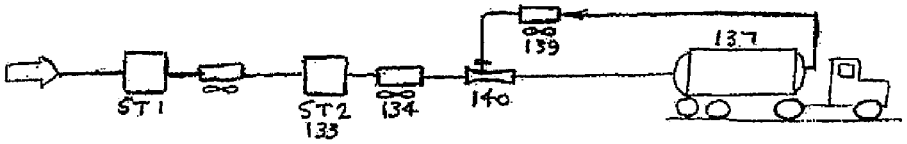
FIGURE 11 (D)

PROCESSING AND TRANSPORT OF STRANDED GAS TO CONSERVE RESOURCES AND REDUCE EMISSIONS

This invention relates to a method of gas production from a field containing natural gas processing particularly for transport of stranded gas to conserve resources and reduce emissions.

BACKGROUND OF THE INVENTION

The traditional way to deliver natural gas to market has always been to ship it by pipeline. However the main factors that determine the viability of such a scheme are volumes of gas to be delivered and the length and cost of the pipeline to bring the gas to market. If the volume of gas is small, the revenues generated by the sale of the gas cannot justify the cost of constructing a lengthy pipeline to deliver the product to buyers. Natural gas which cannot be produced at a profit because it is remote from markets is referred to as stranded gas.

There are numerous examples of non-economic stranded gas but one is very common source is solution gas from oil production. An oil battery's principal activity is to produce oil and the solution gas which is dissolved in the oil is often considered to be a by-product which cannot economically be brought to market. This off gas is therefore often flared. Solution gas is usually rich in liquefiable components such as propane, butane and pentane which, if incinerated along with the lighter gas, represent a significant economic loss as well as waste of a valuable resource.

Another source of stranded gas is the numerous small gas wells which are located in remote areas far from existing pipelines or markets. These small wells often produce from tight formations which have low pressure at the sandface and even lower pressure at the wellhead. Reserves in such reservoirs maybe plentiful but even with fracking, productive life may be short. Such wells are usually capped and the field is not developed because of the unfavorable economics using traditional technology.

Whether the source of the natural gas is solution gas from an oil battery or a small stranded gas well, it is likely that the gas should be compressed if it is to be delivered to a customer. In addition to the pipeline itself, the additional cost of compression equipment adds to the burden of bringing stranded gas into production.

Conventional technology has an envelope within which economic factors such as production rates, revenues, capital expenses and operating costs should create a clear profit. If the balance falls below the lower limit where profit is possible, the plans to exploit the gas are abandoned. The valuable resource is both incinerated and wasted or the wells are capped and the field abandoned. The new technology proposed in this invention can make previously unprofitable projects profitable by bringing natural gas from stranded oil and gas fields to market economically, thus exploiting and conserving a valuable resource and avoiding the wasteful practice of flaring.

SUMMARY OF THE INVENTION

It is one object of the present invention to provide a method of gas production from a field containing natural gas which provide processing and transport of stranded gas to conserve resources and reduce emissions.

According to the invention there is provided a method of gas production from a field containing natural gas comprising:

- extracting gas supply from a plurality of individual gas wells in the field;
- initially at the individual gas wells providing a recovery unit having a production capacity arranged to approximate that of the well for carrying out liquid recovery from the gas supply and compression of the natural gas;
- transporting the compressed natural gas to a point of delivery;
- when a production rate of the well declines to a level which no longer approximates to that of the recovery unit:
  - removing the recovery unit for redeployment;
  - substituting the recovery unit by a dehydration system and gas compressors having a lower production capacity;
  - and transporting the compressed natural gas to said point of delivery.

The compressed natural gas can transported at least in part using portable pressure vessels or using short pipelines to a central processing plant.

In one preferred arrangement, the initial recovery unit is redeployed to a different well with higher production rate. In this arrangement gas from each low production gas well is transported directly from the well by the portable pressure vessels to the point of delivery and there is provided a liquid recovery unit and compressor at each well.

This allows the liquid recovery unit to process the raw gas into potentially commercial products right at the well using simple, small scale processing equipment.

Preferably the liquid recovery unit and compressor is arranged to be packaged into compact skid mounted units that are easily transportable by truck.

In another arrangement, gas from a plurality of the low production wells is transported to a central plant and gas from each the central plant is transported by the portable pressure vessels to the point of delivery. In this case the gas is transported from the plurality of wells to the central plant by pipe and the gas from the central plant is transported by the portable pressure vessels.

In this case the initial recovery unit can be redeployed to the central plant for separating liquids therefrom where the initial recovery unit can operate at the central plant in parallel with recovery units at other wells.

The maximum number of gas wells feeding said central plant is typically about 10.

Flaring can be reduced or eliminated at each location by liquid recovery at the recovery unit.

Preferably the point of delivery comprises a main gas pipeline. However other arrangements can be used including direct supply to customers or storage facilities depending on the circumstances.

Preferably the distance between each of the plurality of wells and the main gas pipeline is below 100 miles.

Preferably the portable pressure vessels are formed of fiber reinforced polymer. However other materials can be used including steel tanks. The polymer can be thermosetting or thermoplastic resins and the fibers can be metal fibers, ceramic fibers, glass fibers, carbon fibers, aramid fibers, polyolefin fibers, polyacrylate fibers, polyamide fibers, polyesters fibers, and combinations thereof.

Preferably the liquefied petroleum gas and stabilized condensates separated by the recovery unit are recombined with liquids from an oil battery or an upstream oil production separator.

Preferably the flow rate of the gas to be supplied to the portable pressure vessels is arranged to be continuous and at a relatively steady rate.

Preferably the gas to be supplied to the portable pressure vessels is arranged to be dehydrated to a few PPM of water such as by using a desiccant process using silica-gel.

Preferably the transportation of gas by the portable pressure vessels is continuous and related to the supply rate so as to avoid requirement on site for stationary high pressure gas storage.

Preferably the transportation of gas by the portable pressure vessels is arranged to transport the raw unprocessed gas at minimum cost to another site for processing.

Preferably the gas is processed prior to transportation in said portable pressure vessels to remove small quantities of $H_2S$.

Preferably the gas is processed prior to transportation in said portable pressure vessels to cool the gas Preferably the gas is fed into said portable pressure vessels and distributed by an internal sparger running the full length of the vessel where the sparger preferably lays along the bottom of the vessel.

In general the new technology provided by the arrangement described in more detail hereinafter relates to the production of remotely located small flows of natural gas is to compress the gas and transport it to market by wheeled vehicles such as trucks. Each truck is hitched to either single, double or triple trailers, each of which for example, if equipped with three 42" diameter tanks forty feet long, is capable of transporting approximately 250 Mscf of compressed natural gas (CNG) in a single load. A single trailer can ship 250 Mscf, a double trailer 500 Mscf and a triple trailer 750 Mscf approximately.

If composite construction of the tanks is used, the weight of the empty tanks is much lighter than all-steel tanks. This permits using larger tanks to carry more gas while staying within the weight limits imposed by highway regulations. This advanced design for the tanks makes transport of gas by truck more efficient and practical by allowing more gas to be carried in each load.

Whether the gas source is solution gas from an oil battery or from multiple small gas wells, the flow rate of the gas should be continuous and at a relatively steady rate. This means that as one truck/trailer unit is filled up the next truck and empty trailer is standing by, already connected up and ready to begin loading its cargo of CNG. The rate of production ultimately depends on how much gas the buyer wants to accept, but the flow rate at the source should preferably be continuous and be reasonably steady without stopping and starting.

The loading time of the truck/trailer combination can be the net gas capacity of the trailer when loaded divided by the rate at which gas is produced. Loading time depends on whether single, double, or triple trailer units are used. Loading time is also influenced by the final pressure in the tanks when full. Reducing the final pressure can shorten the loading time and it may be done to keep loading time and travel time in better balance.

Another important factor to be considered when planning the loading and unloading sequence is the travel time on the road for the truck/trailer combinations plus the time to connect and disconnect from the loading and unloading stations. This can determine how many trucks are required to complete the circuit. It is reasonable to assume that the travel time between the loading and unloading terminals is the same, whether the truck is travelling empty or full. It is also assumed that the sum of connect and disconnect times is the same for both terminals. It is preferred that the loading time be fixed by production rate and trailer capacity because of the need for continuous flow during loading. However, at the unloading terminal it may not necessarily be mandatory to have continuous flow during unloading. If unloading is not continuous, then there is a waiting time at the unloading station. If unloading is continuous, wait time is zero. Consider the following two examples:

$$\text{Unloading Time} = \text{Loading Time:}$$

$$\text{Connect time} + \text{loading time} + \text{disconnect time} = \frac{\text{Distance one way (miles)}}{(\text{number of trucks})(\text{speed } MPH)}$$

$$\text{Rearrange: Speed } MPH = \frac{\text{Distance one way miles}}{(\text{number of trucks})}$$

$$(\text{Connect time} + \text{loading time} + \text{disconnect time})$$

Estimate number of trucks enroute one way and calculate speed. If speed is reasonable the assumed number of trucks is correct enroute one way. The number of trucks should be an integer and the minimum number is one. If calculated speed is too slow, there will be waiting time at the terminals if the trucks drive faster.

If unloading time is greater than loading time then trucks should drive faster to make up for lost time:

$$\text{Unloading Time} \geq \text{Loading Time:}$$

$$\text{Correction factor for above speed}$$

$$\text{Correction factor} = \frac{\text{Connect time} + \text{unloading time} + \text{disconnect time}}{\text{Connect time} + \text{loading time} + \text{disconnect time}}$$

If the corrected speed is reasonable, then the assumed number of trucks is correct enroute one way.

If the speed is not reasonable assume a new value for the number of trucks enroute one way and repeat the calculation.

The total number of truck/trailer combinations is double the number of trucks estimated above plus one more at each of the two terminals. If desired, spare trailers can be standing by at the loading station and unloading station in case of breakdowns.

To keep the trucks on the road and to reduce driver waiting time, when a truck/trailer arrives at either the loading or unloading rack the first thing the driver should do is park his trailer at the rack and connecting it to the rack facilities. Then disconnect the truck from the trailer and move it to the adjacent trailer which is nearing the end of its cycle. Connect the truck to the trailer and wait until flow is switched to the recently arrived trailer. Then disconnect the trailer from the rack in preparation for departure. After completing the transfer documents, the driver should drive his truck/trailer to the opposite station.

For economy and to minimize maintenance the trucks can be powered by natural gas drawn from the tanks on the trailer.

For the complete transport system two terminals are required; a site for loading the trailers and a site for unloading. For a basic system at the loading site, an inlet separator is required to remove free liquids from the gas. This may only be free water but it may also include hydrocarbon liquids. The gas then proceeds from the separator to a compressor with discharge cooler and separator on every stage to remove possible condensed liquids.

Before the CNG can be loaded into the trailers it should first be dehydrated to a few PPM of water. A low water dew point is required because cryogenic temperatures are encountered during processing and when the gas is chilled during unloading due to auto-refrigeration effect.

The dehydrator is probably located on an inter-stage of the compressor, depending on the pressure of the inlet gas. The most likely dehydration process to use is the desiccant process using silicagel or molecular sieve because of the low dew point required.

As a minimum the equipment required for a basic system at the loading site is gravitational separators, a dehydrator and a gas compressor. Provision should also be made for free liquids, if any, to be removed from the site, either by trucking or in the case of free water possibly by local disposal. There is normally no requirement on site for stationary high pressure gas storage because the plan normally is to load gas directly into the trailers coupled to the loading rack as soon as the gas leaves the compressor. The CNG entering the tanks in a basic system is dehydrated unprocessed raw gas which is to be processed after it is off loaded at the unloading site. In a more complex system, liquids are recovered from the gas before it is loaded into the trailers.

It could be possible to incorporate stationary tanks at the loading and unloading sites but in most cases this unnecessarily complicates the process and adds to the cost.

The basic system described above provides minimal processing at the loading terminal with the goal being to transport the raw unprocessed gas at minimum cost to another site for processing. However an alternate method could also be considered.

Transport of CNG by truck or even by train necessarily means that production rates are low and that processing equipment is be miniature by industrial standards. However, in spite of the small size of the equipment, depending on local marketing conditions, it may be economical as an alternative to the basic system described above to process the raw gas into potentially commercial products right at the loading site using simple, small scale processing equipment. For example a moderately rich gas stream could hypothetically be processed into 3 MMscfd of pipeline quality gas to be delivered by truck to users, plus 100 BPD of propane/butane mix produced to commercial specifications and 30 BPD of a non volatile stabilized hydrocarbon condensate consisting mainly of pentane and heavier components. A proprietary cryogenic process based on the Clausius Clapeyron expansion principle can typically recover 80% or more of propane from the feed gas and 95% or more of pentane and heavier. A variation of the same process can also recover ethane. Desiccant dehydration is necessary if a deep cut process is used.

The process to recover commercial products typically requires three pipe sized fractionation columns, a miniature propane refrigeration unit and a small reciprocating process compressor unit. Storage tanks or trailers on site are also required on site for the liquid products which, it is anticipated, is trucked to market. This equipment is all required in addition to the separators, dehydrator and compressor required for the basic system.

Whether the basic system or the more complex process to recover liquid products is chosen, there are no emissions from the process except possibly engine exhaust or heater stack emissions and no waste product streams except water which is disposed of in an environmentally acceptable manner.

The decision whether to choose a basic system or the more complex liquid recovery process at the loading site is a decision based on markets and on local economic conditions.

The most fortunate situation is when the gas entering the process does not contain objectionable components such as $H_2S$, organic sulphur or excessive amounts of $CO_2$. If commercial products are being produced, the presence of these contaminants could exceed commercial specifications. Also, in some jurisdictions the level of sulphur compounds in CNG that can be transported by truck is severely limited. If commercial liquids are produced on site using a cryogenic process it may be necessary to reduce $CO_2$ concentration to prevent freezing of $CO_2$ in low temperature equipment. Also, cryogenic temperatures can be encountered during de-pressuring of tanks at the unloading station which may determine the need to reduce $CO_2$. Because the volume of gas to be processed is relatively small, the simplest and most practical way to remove small quantities of $H_2S$ is to use a non regenerable chemical such as iron oxide which removes $H_2S$ down to 4 PPMV or less and partially removes mercaptans. If quantities of sulphur exceed the practical limit for non regenerable chemicals then processes such as SulFerox or amine which use circulating regenerable liquids could be considered. The non regenerable process and the SulFerox process both produce a solid waste that should be trucked away. The amine process removes both $H_2S$ and $CO_2$ from the feed gas and releases them in gaseous form from the regenerator. If quantities of these contaminants are small they may be incinerated. If quantities of $H_2S$ are significant, further processing is required. A major goal in the development of this invention is to package the processing equipment into compact skid mounted units that are easily transportable by truck. The equipment is relatively small so this concept is quite practical. The skids are designed to rest on gravel pads to eliminate the need for foundations. This also makes it easier to return the site to its natural state when gas production is abandoned. When production ceases, the skid mounted packaged equipment is loaded up and transported to the next location.

In any CNG transport system an important thing to consider is the thermodynamic heating effects that occur to the gas which is already in the tanks as it is pressured up during loading. Cooling of the gas in the tanks which occurs during unloading due to thermodynamic effects in the gas when the pressure is reduced should also be considered.

During loading the gas as it enters the tank is relatively cool, but after it enters the tank the pressure of the gas already in the tank increases and the resulting heat of compression causes the temperature to rise. When the tank is empty its pressure may be, for example, 150 psig, and when it is full the pressure could be approximately 3400 psig. Final pressure depends mainly on the structural design pressure of the tanks. The first gas that enters the tank at low pressure goes through the full range of pressure increase and is therefore the hottest gas. If there is no internal flow distributor for the inlet gas, the hottest gas in the tank is forced to the far end of the tank and since longitudinal thermal mixing is limited, the far end of the tank could become very warm. Therefore the inlet gas should be distributed by an internal sparger running the full length of the tank. This assures that incoming gas is distributed uniformly and that the heat of compression inside the tank is averaged over the entire length of the tank. The sparger should lay along the bottom of the tank so that condensed liquids, if any, are drawn out of the vessel when the tank is unloaded. It is not unusual for liquids to condense during de-pressuring due to the low temperatures that may be encountered, but if a sparger is laid at the bottom of the tank the liquid does not pool since it is drawn out of the tank as soon as it forms.

The compression of the gas inside the tanks is not entirely adiabatic because some heat is transferred by free convection to the cool walls of the tank. An all steel tank is capable of absorbing a lot of heat because of its great mass of metal, but a composite tank with its non-metallic components picks up much less heat because of its reduced mass and does therefore not have as great a cooling effect on the gas. Excessively hot gas in the tank is objectionable because it reduces the weight of gas that can be carried in the tanks as cargo. For example, at 3400 psig, a 30° F. reduction in gas temperature increases the CNG payload by approximately 8%. Also, for composite tanks, excessively high temperatures may have a detrimental effect on the non metallic components of the tank.

There are several options for dealing with heat of compression inside the tanks. The cool walls of the tank will absorb a significant amount of heat from the gas and should be included in the heat balance. However there is always a degree of uncertainty in calculating the final temperatures of the gas in the tank because the initial temperature of the empty vessel itself is usually not known. During unloading, the vessel is cooled by de-pressuring of gas inside the tanks and the tanks may remain cool when the empty vessels are transported back to the loading station. If the initial temperature of the tank is cold, the vessel is capable of absorbing more heat from the gas before the system approaches temperature equilibrium when the tanks are full. This results in a lower final gas temperature when the filling cycle ends.

Gas temperature in the tanks during filling is something to be concerned about and there are several approaches to the problem. The first option is to do nothing. This is the usual approach when all-metal tanks are used. The massive weight of the tanks themselves acts to absorb a lot of heat and reduce the gas temperature to what is considered to be an acceptable level. Gas exiting from the final stage of compression is cooled, usually by ambient air, then flows in this case directly to the tanks. If the coolant is ambient air the ambient temperature can be extremely variable, but for design purposes a CNG discharge temperature into the tanks not exceeding 120° F. is a reasonable typical temperature. For a composite tank the final average temperature in this case is in the neighborhood of 160° F., assuming that the initial temperature of the tank was near ambient. The final gas temperature for an all metal tank is a few degrees cooler.

Doing nothing about the uncontrolled rise in temperature inside the tanks is obviously the simplest and least expensive way to produce CNG, but there are direct benefits to be considered in cooling the gas. For example, if the gas could be inexpensively cooled by 30° F., the quantity of gas in the tanks would increase by approximately 8%. This means that for every twelve loads carried it is as if an extra load is delivered at minimal extra cost, so it is a goal worth pursuing.

One way to reduce the final temperature of the gas is to provide supplemental cooling for the CNG after it leaves the discharge cooler on the final stage of compression but before it enters the tanks. There are several ways to cool the gas before it enters the tanks.

Joule Thomson cooling can be used to directly cool the gas by taking advantage of the potential pressure drop available between the final stage of compressor discharge and the initial low pressure in the tanks. By holding a back pressure on the gas exiting the final compressor discharge cooler, as the gas expands through the back pressure valve, significant Joule Thomson cooling will occur, especially when the tanks are empty at low pressure. For example, with the goal of attaining a final average gas temperature reduction of 30° F., it could be possible to attain this final temperature by holding a back pressure of 1200 psig on the compressor discharge cooler. When tank pressure was below 1200 psig the choking effect of the back pressure valve would produce cooling, but if the tank is above 1200 psig the valve is wide open and there is no cooling effect. The cooling at the beginning of the fill cycle is sufficient to reduce the final average gas temperature to the desired level. The set point pressure of the back pressure valve could be adjusted to provide the desired degree of cooling. The only capital expense for this option is the cost of the back pressure valve downstream of the final cooler stage and the control loop. There is no change to the compressor itself but its operating profile is altered to provide additional horsepower hours during the time when the back pressure valve was choking the gas flow.

Another way to use the Joule Thomson effect to cool the gas entering the tanks is to use a back pressure valve on the interstage pressure of the compressor. If, for example, the initial pressure in the tank is 150 psig and the final pressure is 3400 psig, multiple stages of compression are required to reach the final pressure. If four stages were used the pressure ratio per stage is approximately the fourth root of the overall pressure ratio. The third stage discharge would then be a maximum of about 1600 psig. A back pressure valve could hold a back pressure of anything up to 1600 psig on the discharge cooler from the third stage. If tank pressure was below the set point of the back pressure controller, Joule Thomson cooling is created in the interstage gas. However, since cooling is required for the final stage gas going to the tanks, a heat exchanger is necessary to transfer the cool energy from the interstage to the gas flowing to the tanks. Joule Thomson cooling is available only when tank pressure was below the back pressure set point. Above this tank pressure the valve is wide open and there is no cooling. It is estimated that a 1500 psig back pressure would produce a 30° F. reduction of final gas temperature in the tanks. For this option a gas back pressure valve is required. Also a heat exchanger can be provided to exchange cool interstage gas temperature to the final compressor discharge gas going to the tanks. This scheme does not change the compressor itself but does increase the horsepower hours for the time when the back pressure valve is activated.

Another way to cool the CNG flowing to the tanks is to use an external means to extract heat energy from the gas. The advantage of external cooling over Joule Thomson cooling is that it is continuous throughout the entire cycle, not just at the beginning when tank pressure is low. Also, cooling by external means is much more energy efficient than cooling by Joule Thomson effect. The preferred source of external cooling is cooling water, if available. Ambient air cooling can reduce gas temperature to a maximum of 120° F. Cooling water as a coolant could probably reduce this temperature by as much as 40° F. An alternate external cooling system could be a small refrigeration unit using a refrigerant such as propane as coolant. Refrigeration could be used to cool the CNG exiting the final stage of compression before the gas flows into the tanks. If a refrigeration system was added to the basic simple system to transport raw gas by truck, it would add considerably to the cost and complexity of the system. However if the loading station included a deep cut system to recover liquids it would already include a refrigeration system and it is easy to tap into the system to cool the gas feeding into the tanks.

Another way to use external cooling to dissipate the heat of compression inside the tanks as they are pressured up is to recycle hot gas from the tanks through an external cooler then flow it back into the tank. This requires a second nozzle in the tank so that recycle gas can be withdrawn. Assuming there is an inlet distribution duct, there should also be a pickup duct running the full length of the vessel for the exit of the recycle gas to avoid pockets of hot gas accumulating in the tanks. Probably the recycle gas is cooled by rejecting the heat to ambient air, but other means such as cooling water could be used. After being cooled the recycle gas would combine with the process gas from the final stage discharge cooler, and then flow into the tanks. There is a small frictional pressure drop in the recycle loop that should be overcome by some means such as a compressor or blower. A high pressure eductor using high pressure process gas as motive force could also be used to induce the recycle gas to combine with the process gas. The cooling load increases with every incremental increase in gas pressure. This is because for every increase in pressure there is also more gas in the tanks that heats up due to compression which should then be cooled. For example for a trailer that is empty it may contain only 600 lbs of gas at the beginning of the fill cycle, so the cooling load is small. But as the process nears the end of the filling cycle there is about 14000 lbs of gas on board and this amount of gas requires a lot of cooling. The flow of recycle gas should therefore ramp up as the fill cycle advances. Initially when the tank is empty the recycle flow can be low, but as the tanks are close to being filled, the recycle gas could equal or exceed the flow of process gas coming from the compressor. Although the discharge head is very low it could be difficult to find a centrifugal compressor or blower for the recycle gas that could accommodate a twenty fold increase in flow rate and pressure that occurs over a single fill cycle. As an alternate, instead of a centrifugal machine, another method to recycle the cooling gas by compressor is to fit an additional cylinder to the reciprocating process compressor. Then as the pressure in the tanks increased, the capacity of the extra cylinder would increase in exact proportion to the demand. Since the discharge head is so low, the horsepower required for this option is almost negligible. Since the extra cylinder is driven off the same crank as the rest of the process compressor, it would automatically compensate for changes in demand due to changes in process flow rate. As an alternative to a recycle compressor, since the head requirement is so low it is possible to use a high pressure eductor to circulate the recycle gas. The eductor is located on the feed line to the tanks, using the pressure of the feed gas to induce recycle gas to flow into the side port of the eductor. It is necessary that the recycle gas be under flow control to control the flow of recycle gas to match the demand of the process. If recycle flow is not controlled excessive recycle flow adds significantly to process compressor horse power. It is expected that the recycle gas can be cooled by ambient air, but other means such as cooling water could be used. The cooler should be designed to take the full pressure of the tanks on the trailers. If direct air cooling is used the header boxes on the cooler should be designed for this high pressure. High pressure header boxes are usually machined from a solid billet of steel and for this reason are extremely expensive. Also, the intricate drilled passage ways inside the billet can restrict flow and create pressure drop, especially at low pressure. As an alternate to high pressure direct air cooling, low pressure indirect air cooling could be used. A high pressure pipe coil is used to contain the high pressure, not the finned air cooler. The high pressure pipe coil is immersed in a bath of volatile liquid such as propane with a containment vessel for both the pipe coil and the bath liquid. As the volatile liquid picks up heat from the pipe coil it evolves vapors which rise above the pool of liquid and flow into a finned air cooler mounted above the vessel that contains the pipe coils. The vapors enter the finned tubes of the air cooler where they reject latent heat to the atmosphere and condense as liquid which drains by gravity back to the liquid pool in the vessel below. An equilibrium is established between the temperature of the recycle stream, the volatile liquid and the ambient air. It is similar to the principle of the heat pipe.

At the unloading station, the process facilities required ultimately depend on what type of service is required by the user of the CNG. In most cases the minimum equipment required is a let-down valve to reduce the high tank pressure to the pressure required by the receiver's system. For example if the initial tank pressure is 3400 psig when full and 150 psig when empty, the gas free flows from the initial pressure of 3400 psig down to the receiver's pressure which is probably above 150 psig. When the period of free flow ends, a compressor starts to evacuate the tanks down to the final pressure of 150 psig while pumping the low pressure gas into the receiver's system. At 150 psig the tanks are considered empty. Liquid condensing, if it occurs, probably occurs during the free flow period of unloading and liquid is swept out of the tanks as soon as it formed. However, liquid should not be allowed to enter the compressor cylinders and a suction drum should be used as a safeguard. As the tanks are de-pressured the gas in the tanks expands and cools. Depending on initial and final pressures and on the extent of condensing in the tanks, the temperature in the tanks could drop approximately 70° F. between being full and being empty. The gas exiting the tank flows through a let down valve during the free flow period of emptying the tank, which creates additional Joule Thomson cooling that initially, can make the gas extremely cold. This is why it is necessary to attain extremely low water content for the gas back at the loading station. For the gas compressor the period of low Joule Thomson temperature has passed before the compressor starts up, so it has no effect on the compressor. The lowest temperature exiting the valve occurs initially when the tanks are full and the pressure drop is at a maximum. But as the tank pressure decreases the exit temperatures from the valve is due to the combined effect of temperature lowering in the tank plus Joule Thomson cooling of the let down valve. The gas temperature rises gradually until tank pressure equilibrates with the pressure of the receiver's system which triggers the startup of the process compressor. After the compressor starts, the let-down valve is wide open and a constant temperature discharges from the compressor. Whether or not the low temperature of the gas is objectionable depends on the destination of the gas. If, for example, the gas is injected into a pipe line where it mixes with large volumes of gas at normal temperatures, the temperature of a relatively small volume of intermittently cold gas would probably be of no concern. However if the gas Is flowing into a local consumer network it may be necessary to warm the gas by some means such as a gas fired water bath heater. Or if the gas was flowing into a deep cut system it may be practical to recover the cold energy of the gas by transferring it into the deep cut processing system. Or another possibility is that the gas could be transferred directly into stationary tanks at the unloading site to serve as a filling station for CNG powered vehicles.

Equipment for the individual wells including the compressor, desiccant unit, and liquid recovery system are very compact and portable for ease of relocation and hookup. For producers who have a marginal gas supply it offers an inexpensive way to get into production. Initially, in its simplest form, the process is a method to reduce flaring while generating revenue by the sale of liquids. Flaring the residue gas is wasteful but the stripping of liquids from the flare gas could reduce the amount flared by about 20%. Reduction of flaring is a benefit to be considered in addition to the recovery of liquids. Whether the source of flare gas is individual stranded gas wells or an oil battery, the most desirable solution is to install the complete system and recover both CNG and commercial liquids and deliver them to market, thus eliminating flaring completely.

Liquids including LPG and stabilized condensate can be recovered and delivered to market by truck, or in the case of stabilized condensate it can possibly be recombined with liquids from the oil battery or production separator upstream. Integration of the liquid recovery process into facilities upstream should be considered on a case by case basis. The same basic deep cut technology could also be used to recover ethane in addition to LPG and stabilized condensate but, because of its high vapor pressure, unless it is chilled it would most likely be marketed as a gas. This makes it more difficult to transport to market.

In the case of stranded gas wells the entire gas field can be developed one well site at a time as described above until a number of sites, possibly about half a dozen to a dozen have been put into production. Characteristically with marginal gas wells, especially shale gas wells, the production rate declines rapidly and after about two years of production the gas flow declines to about 20% of the initial flow. This means that the liquid recovery equipment and compressors originally installed on the wells are too big to efficiently handle the reduced production rate and should be moved intact to a new well whose initial flow matches the capacity of the process equipment. A smaller compressor/dehydrator combination can be substituted on the original wells which matches the long term reduced deliverability of the wells. Marginal gas wells, although they decline rapidly, often continue to flow at a reduced rate almost indefinitely. It is not practical to process extremely small volumes of gas for liquid recovery on site so it is necessary to group the production from several small wells together and send it by a gathering system consisting of small short pipelines to a central location for processing. The moderately sized central deep cut plant is strategically placed in the midst of the small wells to minimize the cost of the pipelines connecting the well sites to the central plant. Gas delivered from the wells to the central plant is dehydrated and compressed to a level that delivers the gas to the plant at about 500 psia, but on entry into the plant the gas is not yet stripped of hydrocarbon liquids.

The process used in the central plant is essentially the same deepcut process used originally at the well sites except on a larger scale. The products are the same, CNG, LPG, and stabilized condensate, all of which are shipped to market by truck or possibly by train. In some cases ethane can also be a commercial product. Non-commercial products such as Y-grade liquid can be produced if there is a market for it. The choice of products depends mostly on what the market demands.

One thing that should be planned in advance is how many wells the central plant can serve. This is part of the planned development of the field, to know what gas flow the central plant ultimately can handle. The location of the central plant and the most economical design of the gathering system between the wells and the plant is an essential consideration in the design and layout of the system. Pipelines from the wells to the central plant should be kept as short as possible to minimize the cost.

As development of the field progresses the initial high capacity process packages are moved one by one to new well sites when initial gas flow declines to its long term stable flow rate. The original units are replaced by low capacity compressor dehydrator units to suit the reduced deliverability of the wells. The new low capacity units dehydrate and compress the gas and deliver it via a short pipeline to a central deep cut plant to recover CNG and hydrocarbon liquids. Conversion of the individual wells to the low capacity system occurs gradually, probably one well at a time, requiring that the central plant be capable of accommodating a very wide range of flow rates, starting possibly at about 10% of design rates and building gradually to 100%. The Clausius Clapeyron expansion process, which is the heart of the deep cut system, is capable of turn down to extremely low rates. This is unlike conventional deep cut processes that are based on turbo expanders which are extremely inflexible in turn down ability.

It is important that so long as the field is developing and new wells are continuously being opened up, the existing high capacity process packages should be relocated to new wells, to be replaced by new low capacity compressor/dehydrator units on the old wells and that ideally all equipment is in use and there is no surplus equipment left over. But eventually, the field is fully developed and all of the wells are tied into the low capacity compressor/dehydrator combinations. At that point there are several high capacity process packages left over. The number of left over units depends on the pace of new wells being brought on stream. The time interval between installing high capacity units on new wells is critical. If, for example, two new wells are brought on stream each year and if it requires two years for each well stabilize at its diminished flow, then there are four high capacity units required which eventually become surplus when the field is fully developed. Likewise if four new wells are tied in each year eight high capacity packages is required and eventually eight units become surplus.

However, since the process employed in the high capacity units is similar to the process used in the central plant, it is possible to recycle these surplus units into the final central plants being situated in the gas field. Assuming that the diminished flow of each well declines to 20% of initial flow, one high capacity process package could serve up to five wells. For example if the plan is for a typical central plant to serve ten low flow wells in a 30 well field, then two high capacity units can be configured to run in parallel at a central plant facility for processing and compression for 10 wells. Assume that a typical well requires two years to decline to its stable 20% flow rate. Suppose the plan has been to tie in two new wells per year, then eventually there are four surplus high capacity units left over when the entire 30 well field was developed. For the first 10 wells a new central plant #1 is required. But for the second block of ten wells, in order to avoid having surplus units left over, one of the four high capacity units left over can be located centrally as the beginning of central plant #2. This leaves three high capacity units available to develop new wells, and central plant #2 meanwhile serves the first five wells of the second block of ten wells. Eventually another of the potentially surplus high capacity units are refurbished and moved to central plant #2 to run in parallel with the first unit. In order to use up the final two surplus units by the time the field is fully developed only one new well is tied in per year, resulting in a surplus of two high capacity units which can be reconfigured one at a time to run in parallel at the proposed central plant #3, serving the final ten wells. By staging the development logically in this way, the maximum use can be made of the invested capital. The disadvantage is that development would proceed slowly.

Alternatively, instead of reconfiguring the high capacity units to serve as central plants, they can be kept intact and moved to an entirely new field where the development process can begin again. In that case the surplus units are really surplus because they are put to immediate use in the new field. Development of the first field has then proceeded rapidly without the delay caused by recycling high capacity units to serve as central plants and all central plants are new, purpose designed plants.

BRIEF DESCRIPTION OF THE DRAWINGS

FIGS. 11A, 11B, 11C and 11D show four arrangements for cooling CNG before it enters the tanks, where FIG. 11A shows Joule Thomson cooling from interstage, FIG. 11B shows Joule Thomson cooling from discharge, FIG. 11C shows cooling CNG by external coolant and FIG. 11D shows cooling of the recycle stream.

DETAILED DESCRIPTION

Figure 1:
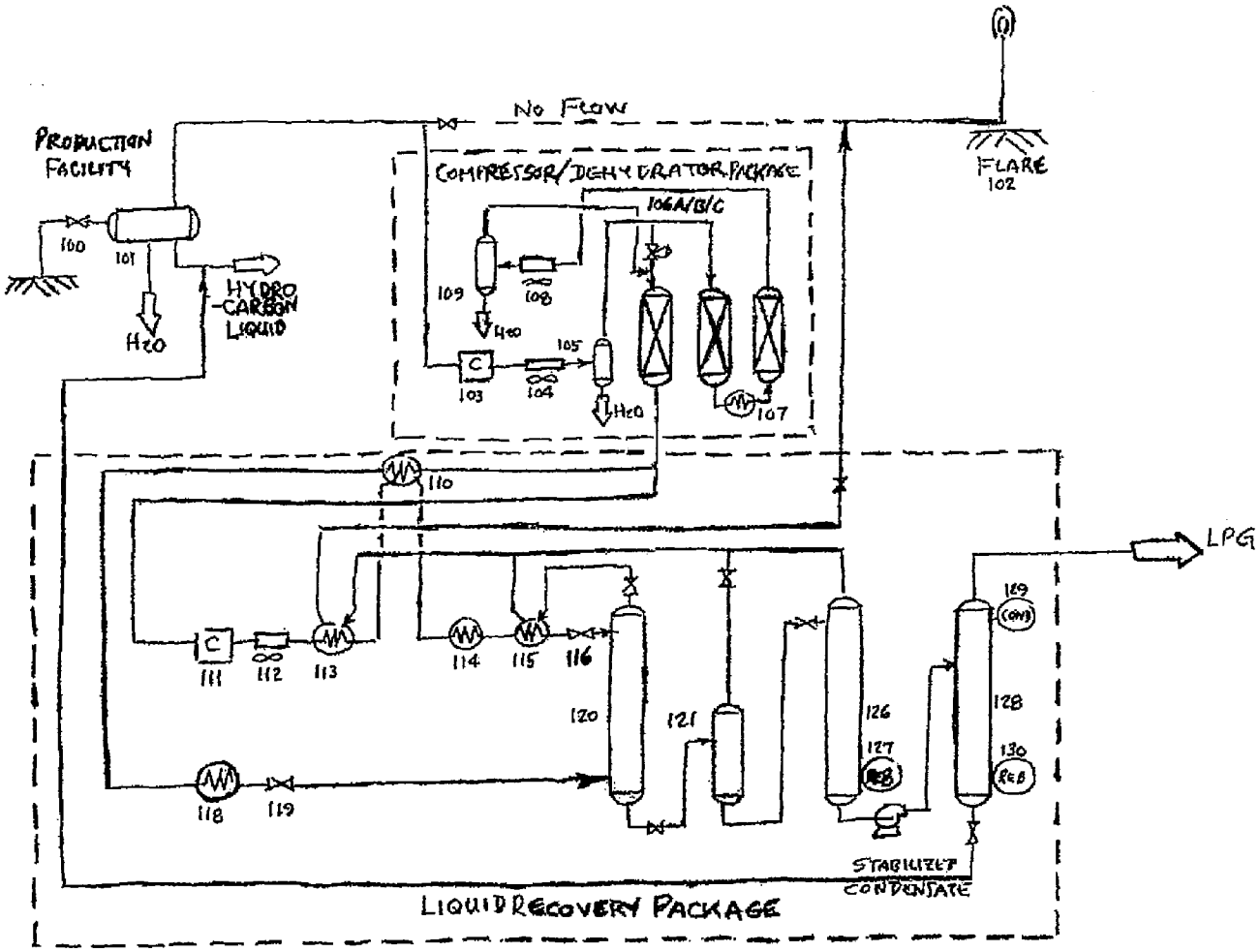
FIG. 1 is a schematic layout of a first arrangement according to the present invention for reduction of flare gas by recovering propane plus.

FIG. 1 shows reduction of flare gas by recovering propane plus and illustrates a typical facility where the quantity of flare gas is decreased by stripping the gas of liquefied components such as LPG and stabilized condensate. Recovery of liquids typically reduces flaring by as much as 20% depending on the composition of the flare gas. FIG. 1 is a process scheme based on the Clausius Clapeyron Expansion Principle to recover propane and heavier hydrocarbon components. The advantage of this process over conventional turbo expander processes is its extreme flexibility, especially its wide operating range in handling varying flow rates. The LPG produced meets commercial standards for marketing and the stabilized condensate meets commercial standards for Reid vapor pressure. Details of the process may vary somewhat depending on operating conditions, the composition of the gas and the required specifications for the products.

In FIG. 1, items 100 and 101, which are both upstream of the proposed patented process scheme, represent typical production equipment in the field such as a valve 100, to control pressure and flow of the wellstream, and separation equipment 101, which divides the incoming stream into its three respective phases of gas, hydrocarbon liquid, and water. For gas wells, this equipment would primarily be gravitational separators and for oil wells, the equipment is a combination of gravitational separators and oilfield treaters. For gas wells, if liquids from the separation equipment were sufficient to justify production in spite of a lack of market for the gas, then the byproduct gas would conventionally be sent to flare stack 102, likewise for oil batteries. The non-marketable gas is sent to flare.

By the use of this invention, instead of sending what is considered to be waste gas to flare, it is diverted to a compressor 103 and a gas discharge cooler 101, which raises the pressure to approximately 500 PSIA at 120° F. The gas then flows to a desiccant dehydrator 106A/B/C, which may be either two tower or three tower units, depending on conditions, and it may also sometimes remove a small quantity of hydrocarbon liquid in addition to water. For regeneration, either dry product gas or wet inlet gas can be used to regenerate the beds of desiccant. Regeneration gas is typically heated in a salt bath heater 107 and cooled in an air cooled heat exchanger 108 which condenses water and possibly some hydrocarbon liquid which is removed from the regeneration stream in separator 109. The gas from the separator 109 then recombines with inlet gas entering the desiccant towers.

Downstream of the dehydrator the dry gas is divided into two streams, one of which is cooled in a gas/gas exchanger 110, then proceeds to a propane refrigerated chiller 118, then to an expansion valve 119, then enters the gas fractionator 120 below the bottom stage. The other dry gas stream flows to a compressor 111 and a discharge cooler 112 which raises the pressure to approximately 1500 PSIA at 120° F. The gas is then cooled in Gas/Gas exchangers 113 and 115 and in propane refrigerated chiller 114. Propane is the refrigerant normally used in gas processes but other commercial refrigerants could also be used. The chilled gas then enters the expansion valve 116 which lowers the pressure to approximately 450 psia, resulting in an extremely cold feed stream entering the gas fractionator 120 at the top stage of the column. In the FIG. 1 version of the process there is no market for the gas, so the residue gas from the gas fractionator is sent to flare 102 after the liquids have been stripped out.

The bottom liquid product from the gas fractionator 120 contains the propane and heavier components which are to be recovered, but the liquids are heavily loaded with light gases, mainly methane and ethane which should be separated from the liquid product. Most of these light gases can be flashed off in the deethanizer's feed flash drum 121 without losing a significant amount of recoverable liquid. The overhead vapor from the flash drum is sent to flare stack 102.

Bottom liquid from the flash drum 121 is reduced in pressure by a let-down valve which produces a very cold feed stream which enters on the top stage of the deethanizer 126. The deethanizer is typically a top feed fractionator without a reflux condenser but with a bottom reboiler 127 which produces the necessary temperature profile in the column. Normally the specification imposed on the bottom product from the deethanizer is that the molar $C_2/C_3$ ratio should not exceed 2%. The light gases, mainly methane and ethane that are stripped from the liquid in the deethanizer are sent to the flare 102. Losses overhead of valuable liquids in the deethanizer overhead vapor are not significant.

The bottom liquid that flows from the deethanizer contains the liquid product that can be recovered from the flare gas. The purpose of the debutanizer 128 is to separate the incoming mixture into the final products, normally Liquefied Petroleum Gas (LPG), a mixture of volatile hydrocarbons consisting of mainly propane and butane, and stabilized condensate, consisting mainly of pentanes and heavier. The debutanizer feed enters at about mid stage of the column, and the feed stream is often boosted in pressure with a pump so that the reflux condenser can use ambient air as coolant. The debutanizer has an air cooled reflux condenser 129 and a bottom reboiler 130.

The LPG is a pressurized product so should be stored under pressure. It may be stored on site in a stationary tank to be offloaded into a propane truck, or it could be loaded directly into a trailer stationed at the site to be picked up and delivered to market as required. The commercial specification that normally applies to the LPG is that the $C_2/C_3$ ratio should not exceed 2%. This ratio is determined in the deethanizer.

The bottom product is stabilized condensate which normally is produced with a Reid Vapor Pressure specification not exceeding 12 psia. From a single source such as a small well the quantity of stabilized condensate can be relatively small. The most convenient way to handle it is to recycle it back to the inlet separation facility 101 and combine it with the liquid hydrocarbon leaving the inlet separator. Alternatively, the stabilized condensate could be cooled by tube and shell or by air cooled heat exchanger, and then stored on site in a small atmospheric tank. The condensate has been de-gassed so has very low vapor pressure to enable storage by atmospheric pressure. It could be trucked to market when the on-site tank was full.

The process equipment in FIG. 1 is self contained and provides a complete processing facility when installed on an individual gas well or oil battery.

Figure 1B:
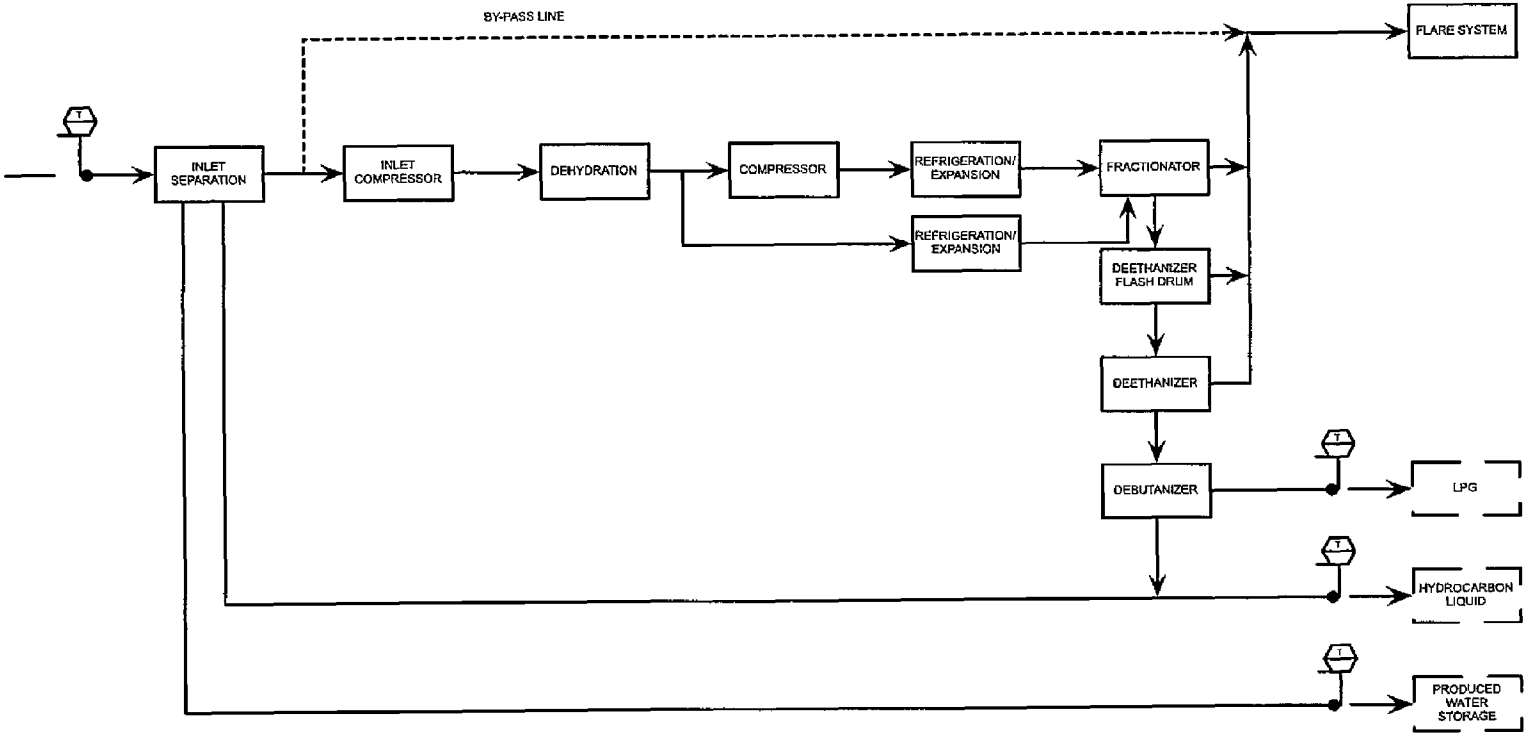
FIG. 1*b* is a schematic layout of the arrangement of FIG. 1 at a high-level.

FIG. 1*b* is a simplified block diagram of FIG. 1 showing a typical facility where the quantity of flare gas is decreased by stripping the gas of liquefied components such as LPG and stabilized condensate.

Figure 2:
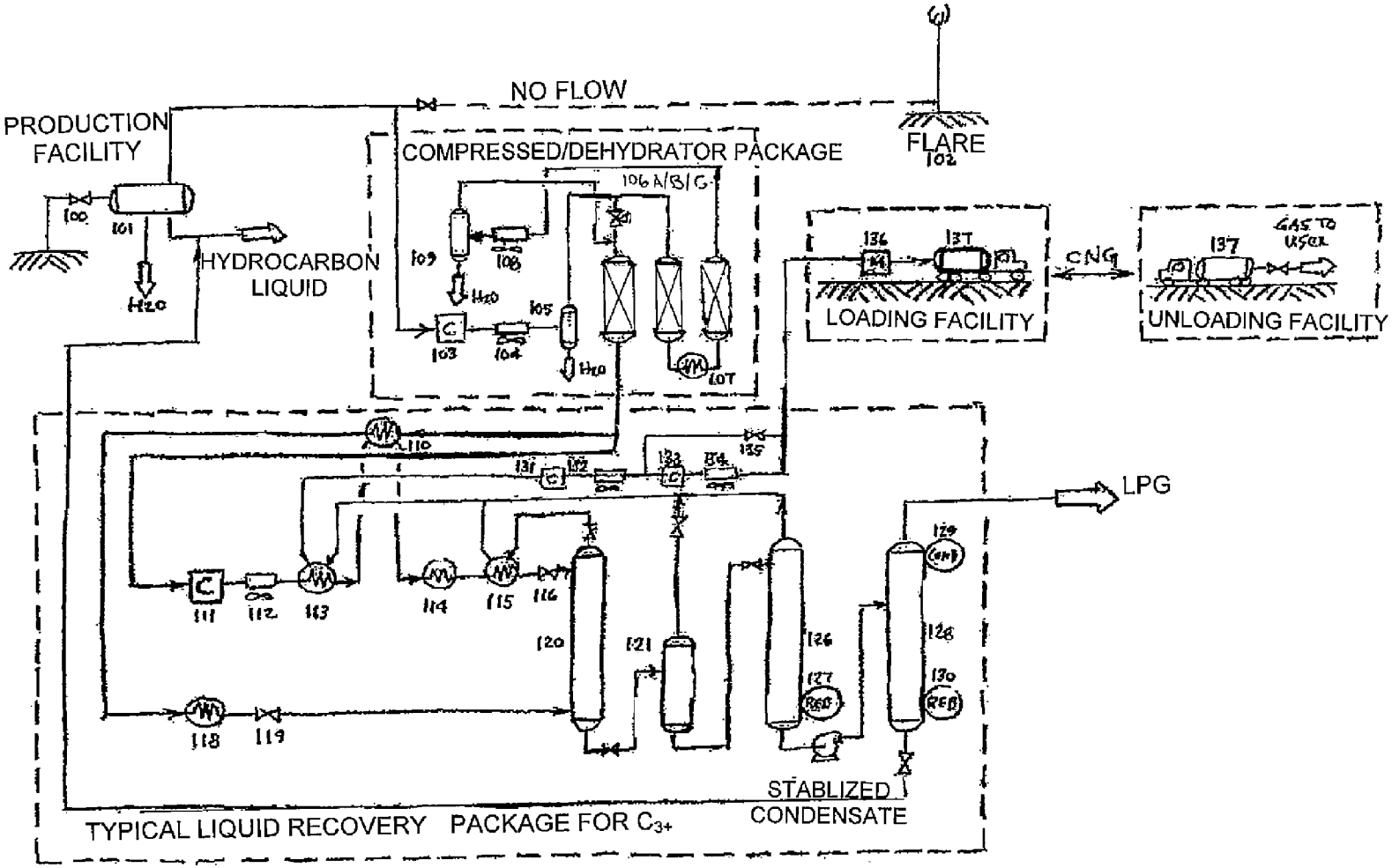
FIG. 2 is a schematic layout of a second arrangement according to the present invention for total recovery of CNG and liquid from flare gas.

In FIG. 2 is shown an arrangement for the total recovery of CNG and liquid from flare gas. The details of the upstream production facilities, compressors, dehydrators, and liquid recovery packages described in FIG. 1 apply also to FIG. 2. The only difference is that instead of sending residue gas to flare it is compressed, cooled and loaded directly into special CNG tanker trucks to be transported as commercial product to market.

The combined overhead vapors from the gas fractionator, the feed flash drum, and deethanizers, after transferring cold energy back into the deep cut process, are compressed in two stages to a final pressure of approximately 3415 psia. This choice of the final pressure depends on the design of the tanks on the trucks. The inter-stage discharge has a back pressure valve 135 to hold a constant back pressure on the first stage compressor 131 downstream of the air cooled exchanger 132 during the initial stages of filling when tank pressure is below inter-stage pressure. This is to provide Joule Thomson cooling of the gas through valve 135 as it flows into the tank 137 from the time when the tank is empty until the tank pressure equals inter-stage pressure. Cooling the gas during the early stages of filling can prevent the final temperature in the tank from rising too high. When tank pressure reaches inter-stage pressure the gas flow is diverted from the back pressure valve 135 to the Stage 2 compressor 133 and its discharge cooler 134 which then starts up and continues to fill the tank until fully charged. The CNG is metered 136 at the loading station.

As the tanks near their loaded capacity a second truck arrives which is empty. It is connected up in readiness to receive its cargo of CNG when the first truck is fully loaded. Flow of gas during loading is continuous without interruption. The loaded truck departs and carries its cargo to the destination where it is unloaded under controlled conditions into the users system.

Figure 2B:
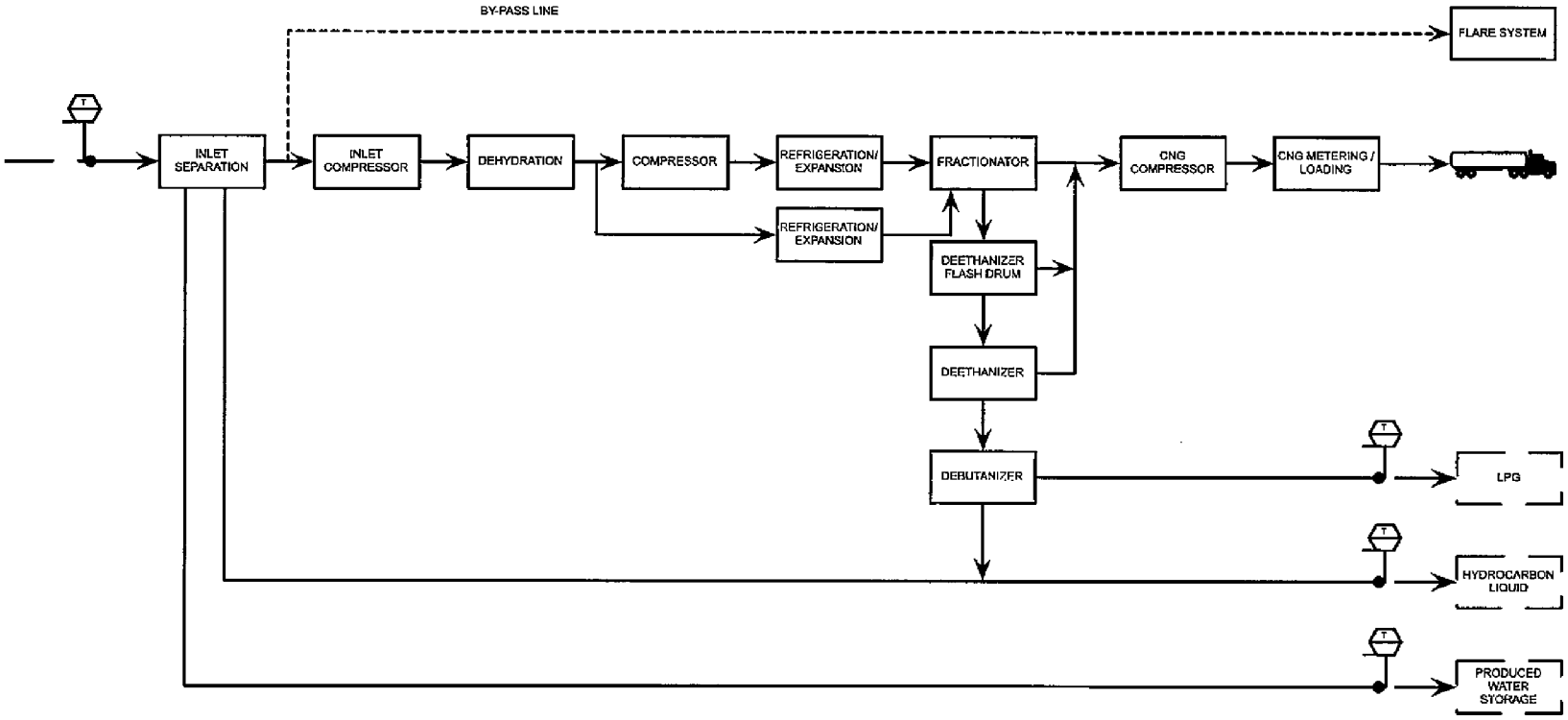
FIG. 2*b* is a schematic layout of the arrangement of FIG. 2 at a high-level.

FIG. 2*b* is a simplified block diagram of FIG. 2 showing a typical facility where the flare gas is eliminated by stripping the gas of liquefied components such as LPG and stabilized condensate and the residual gas is compressed, cooled and loaded directly into special CNG tanker trucks to be transported as commercial product to market.

Figure 3:
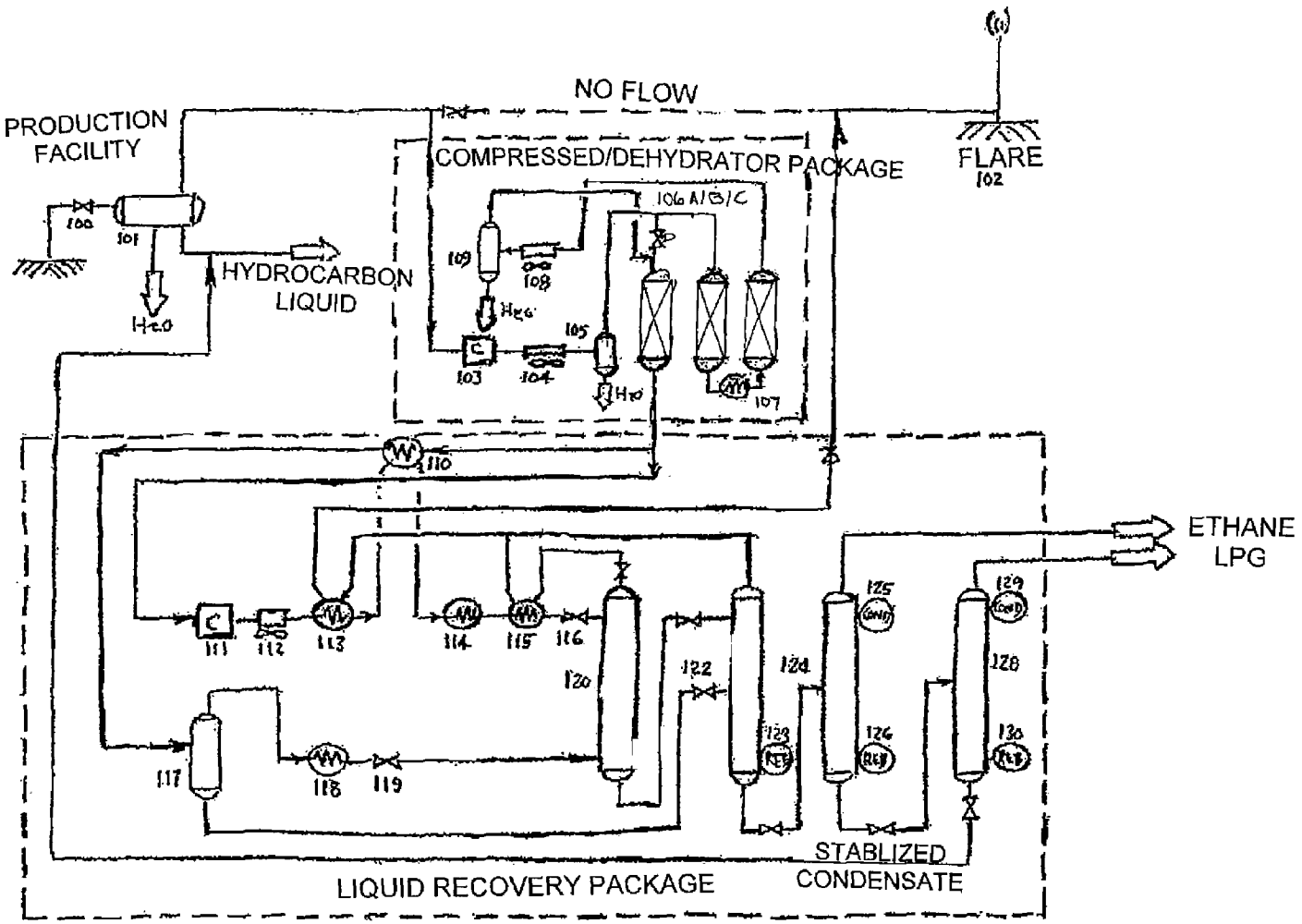
FIG. 3 is a schematic layout of a third arrangement according to the present invention for reduction of flare gas by recovering ethane and heavier components.

FIG. 3 shows a reduction of flare gas by recovering ethane and heavier components and is generally similar in principle to the process described in FIG. 1. Like FIG. 1, the FIG. 3 process scheme is intended to be installed at individual well sites or oil batteries and it includes compression, dehydration, and recovery of commercial products, but the difference is that the FIG. 3 process also recovers ethane in addition to LPG and stabilized condensate. Ethane is a volatile component and at normal ambient temperatures it is probably a gas having a vapor pressure approaching 1000 psia. Therefore the usual way to ship ethane is as a gas in a pipeline, or it could be compressed and shipped by truck, the same as CNG. Or, if it could be chilled to 0° F. or less it could be shipped as a liquid at about 250 psia, provided that it could be continuously cooled. FIG. 3 recovers ethane as a gas but does not show how it is shipped to market.

The production facilities 100 and 101 upstream of the process in FIG. 3 are identical to the corresponding items 100 and 101 in FIG. 1. The compressors and the dehydrator in FIG. 3 are also identical to those in FIG. 1. The differences are all in the deep cut liquid recovery process.

The first difference occurs when the dry gas is split into two streams. The first stream is cooled by a gas/gas exchanger 110 then flows to a flash drum 117, the overhead vapors from which flow to chiller 118 and valve 119 and enter the gas fractionator 120 as a bottom feed. FIG. 1 had no flash drum. The second dry gas stream flows to compressor 111, cooler 112, exchangers 113 and 115, chiller 114, then through expansion valve 116 to produce an extremely cold stream that enters the gas fractionator 120 as the top feed, the same as in FIG. 1.

Although there are physical similarities to FIG. 1, the process to recover ethane in general requires lower temperatures in the gas fractionator than are required to recover propane and heavier as in FIG. 1. As before, the residue gas from the gas fractionator is sent to flare. The bottom liquid from the gas fractionator is sent to the second fractionator in the line, the demethanizer (122).

For the recovery of ethane the process requires an additional fractionating column, the demethanizer, 122 to remove light gases, principally methane from the liquid mixture. The bottom product from the gas fractionator 120 is reduced in pressure by a level control valve and then enters the demethanizer 122 at a very low temperature as top feed. Liquids from the flash tank 117 also enter the demethanizer at about the midpoint of the column as a second feed. Because the demethanizer 122 has a very cold top feed a reflux condenser is not required. A bottom reboiler 123 provides heat for the necessary temperature profile in the column. The overhead vapor from the demethanizer has no market so is sent to flare. The specification imposed on the bottom product from the demethanizer is typically a molar ratio of $C_1/C_2$ not exceeding 2%. This is to enable a relatively pure ethane stream to be produced in the following fractionator. The bottom liquid leaving the demethanizer contains all the commercial products to be recovered by the process. Subsequent fractionation just divides the liquid into the desired products.

The bottom liquid exiting the demethanizer 122 flows downstream and enters the deethanizer 124 as feed at approximately the mid-point of the column. The purpose of this deethanizer is to separate the product, ethane gas, as overhead from the propane and heavier components in the feed. Since methane and light gases have already been removed, and since a relatively high reflux ratio is used in the deethanizer 124, a relatively pure ethane product can be produced. The deethanizer has a refrigerated reflux condenser 125 and a bottom reboiler 126. The bottom product from the deethanizer is a liquid mixture of propane and heavier, which, as in FIG. 1, flows to the debutanizer.

The bottom product that flows from the deethanizer 124 contains LPG and stabilized condensate as a liquid mixture and it is the function of the debutanizer 128 to separate the mixture into the desired commercial products. The operation and function of the debutanizer is exactly as described previously for FIG. 1.

Figure 4:
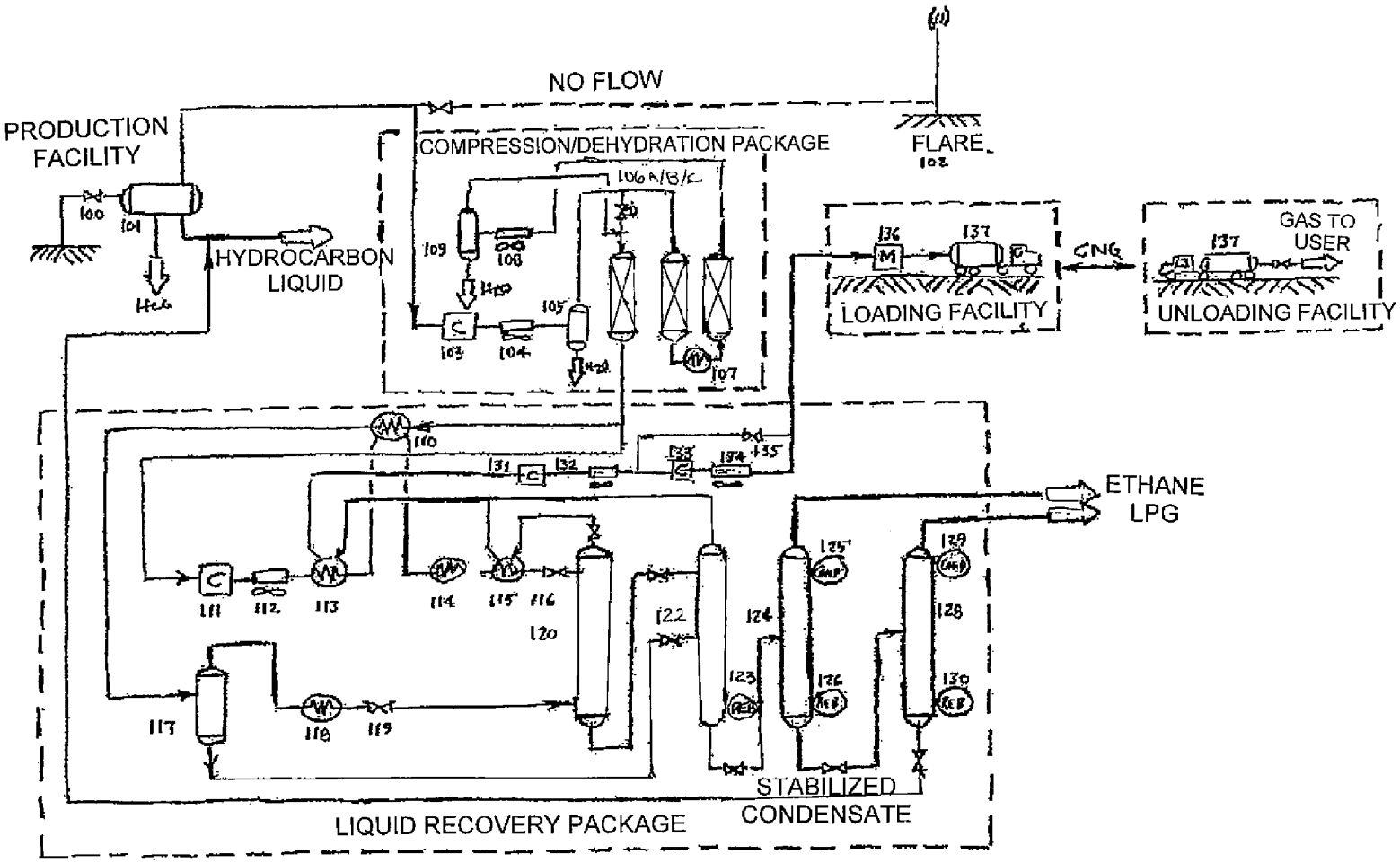
FIG. 4 is a schematic layout of a fourth arrangement according to the present invention for total recovery of CNG and liquid from flare gas.

FIG. 4 shows the total recovery of CNG and liquid from flare gas and the details of the upstream production facilities, compressors, dehydrators and liquid recovery packages described in FIG. 3 apply also to FIG. 4. The only difference is that instead of sending residue gas to flare it is compressed, cooled, and loaded directly into special CNG tanker trucks to be transported as commercial product to market.

The deep cut process detailed in FIG. 4 recovers ethane in addition to LPG and stabilized condensate. Ethane leaves the process in the form of a gas at a pressure probably below 200 psia. There are various ways to deliver the ethane to market.

a) It could be compressed and delivered by truck using methods similar to the CNG technology b) It could be transported as a liquid at about 250 psia in a truck refrigerated to below 0° F.

c) If an ethane pipeline was in the area, ethane could be shipped by pipeline. Details of the delivery method for ethane have not been detailed in FIG. 4.

The combined overhead vapors from the gas fractionator and the demethanizer after transferring cold energy back into the deep cut process, are compressed in two stages to a final pressure of approximately 3415 psia. The choice of final pressure depends on the design of the tanks on the trucks. The inter-stage discharge has a back pressure valve 135 to hold a constant back pressure on the first stage compressor 131 down-stream of the air cooled exchanger (132) during the initial stages of filling when tank pressure is below inter-stage pressure. This is to provide Joule Thomson cooling of the gas through valve 135 as it flows into tank 137 from the time when the tank is empty until the tank pressure equals inter-stage pressure. Cooling the gas during the early stages of filling can prevent the final temperature in the tank from rising too high. When tank pressure reaches inter-stage pressure the gas flow is diverted from the back pressure valve 135 to the stage 2 compressor 133 and its discharge cooler 134 which then starts up and continues to fill the tank until fully charged. The CNG is metered at the loading station in meter 136.

As the tanks near their loaded capacity a second truck arrives at the loading station which is empty. It is connected up in readiness to receive its cargo of CNG when the first truck is fully loaded. Flow of gas during loading is continuous without interruption. As flow is transferred from one truck to the other, the loaded truck departs and carries its cargo to the destination where it is unloaded under controlled conditions into the users system.

Figure 5:
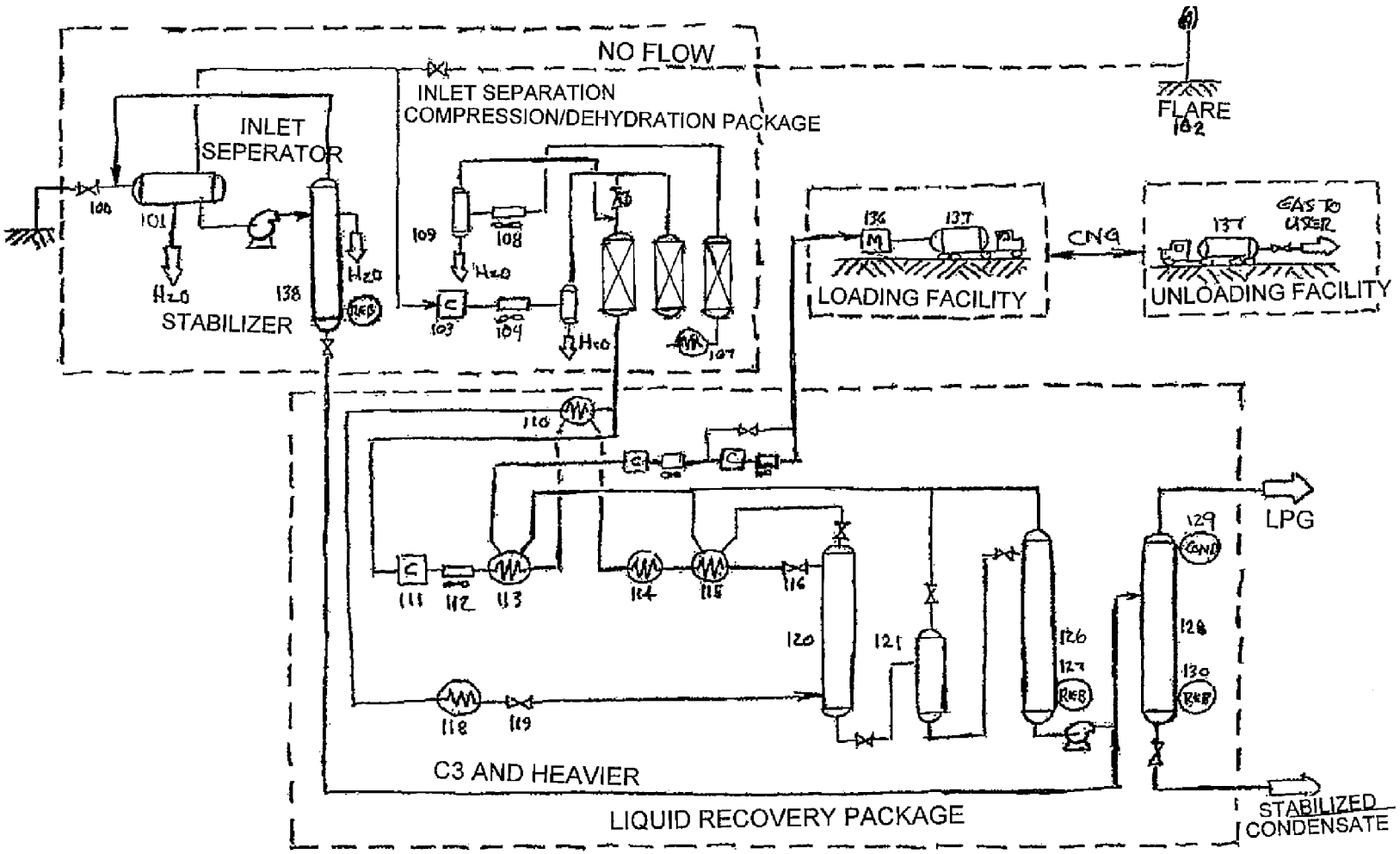
FIG. 5 is a schematic layout of a fifth arrangement according to the present invention for total recovery of CNG and liquid from flare gas with rich feed gas.

FIG. 5 shows total recovery of CNG and liquid from flare gas with rich feed gas where the same references are used as in FIGS. 1, 2, 3 and 4. 101 is the three-phase inlet separator as before, but in this case is integral part with the liquid recovery system. Item 138 is the liquid stabilizer which fractionates the hydrocarbon liquid from the inlet separator.

Feed gas that typically enters the deep cut plant is single phase gas which contains no appreciable amount of hydrocarbon liquid because either the gas is lean and is inherently free of liquid as it exits the well or possibly because the free liquid has already been removed by separation equipment upstream of the deep cut facility.

However in some cases the gas, as it leaves the well, contains significant quantities of free liquid, and if there are no separation facilities upstream, it is necessary to provide additional equipment to handle the free liquids entering the system from the inlet stream. The complicating factor in processing these inlet hydrocarbon liquids is that they can be water saturated and in addition to dissolved water, can typically contain 1,000 to 5,000 ppm of entrained water droplets in a very fine dispersion.

It is difficult to remove water from liquid hydrocarbons to the level necessary to permit processing the liquids at cryogenic temperature. The processing of these liquids should therefore be done at temperatures safely above hydrate of freezing temperatures. It is first necessary to use gravitational separation to separate the inlet stream into its respective three phases of gas, hydrocarbon liquid and free water. The gas proceeds from the inlet separator to compression and dehydration as prescribed previously and the free water is sent to disposal. The water wet hydrocarbon liquid from the inlet separator are then fractioned to produce an overhead product consisting of light gases which are recycled back to the inlet separator. The bottom liquid product should meet the necessary specifications determine the design of the fractionator. The liquid specification is sometime 12 psia Reid vapor pressure, or if the liquid is to be processed for ethane recovery the liquid specification is typically a methane/ethane ration of 1%. If the liquid is being processed to recover propane and heavier, the bottom product is typically an ethane/propane ration not exceeding 2%. The fractionation process normally drives almost all of the water overhead, either as water vapor or as liquid from a water draw off tray. But the bottom liquid can still contain traces of water so should not enter this cryogenic plant unless it is first dehydrated.

If the plant is designed to recover propane and heavier, the stabilizer strips the liquid of ethane and other light gases, so the slightly wet liquid can be sent as feed to the debutanizer without causing excessive ethane content in the LPG. The minor amount of water in the feed is not a problem in this debutanizer because it runs hot. Also, the amount of water is so small it does not exceed allowable limits in the products.

Figure 6:
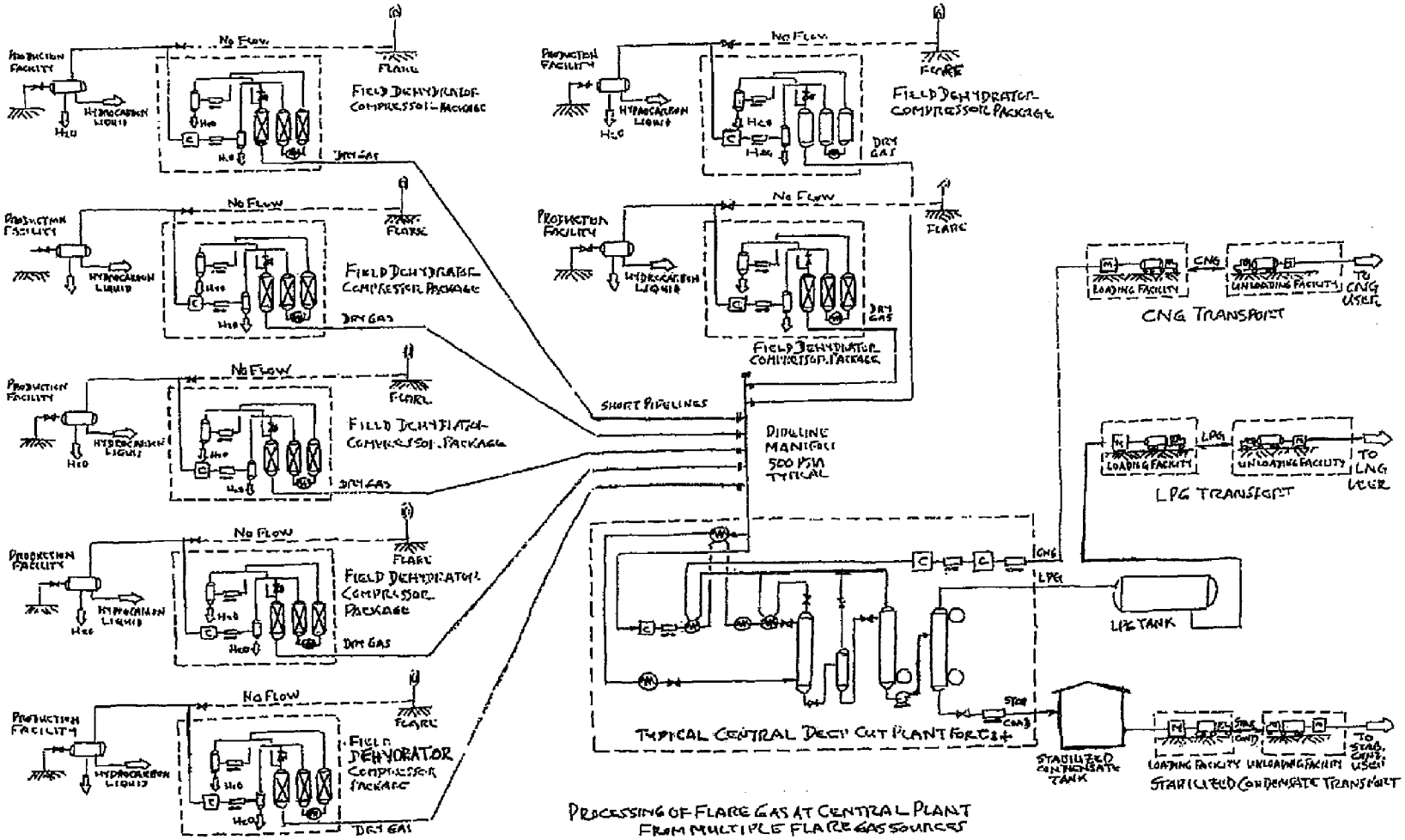
FIG. 6 is a schematic layout of a sixth arrangement according to the present invention for multiple low flow wells feeding into a central plant.

FIG. 6 shows an arrangement for Multiple Low Flow Wells Feeding Into a Central Plant where the most likely application for this patented technology is for relatively small gas wells which suffer a severe reduction in gas production within a fairly short time after startup. Initially that gas flow rate may typically be about 2.5 MMscfd, declining gradually by about 80% to a stable, long term flow rate of about 0.5 MMscfd.

FIGS. 1, 2, 3, and 4 show various process configuration to handle the brief period of maximum flow following initial startup for each individual well. The processes described in those figures are of self contained equipment packages which intake raw, unprocessed, water saturated gas and produce marketable commercial products. These equipment packages are basically intended to be temporarily installed at a well site to process the gas from a single well for the duration of the high flow phase of the operation.

When gas production falls to its minimum stable flow rate, the initial high capacity process package is too big to efficiently process the very low gas flow, so the initial process package, being portable, is disconnected from the well and moved to a new well site which has a higher flow rate. The initial big unit can be replaced at this low flow well by a much smaller package consisting of a miniature compressor/dehydrator combination. Deep cut liquid recovery equipment encounters many difficulties when operating at extremely low flow rates, so the liquid recovery system is relocated to a central processing plant which handles the gas from a cluster of several miniature compressor/dehydrator packages located at the low flow well sites.

FIG. 6 shows a typical development where the self contained high capacity units have been replaced by seven of the miniature compressor/dehydrator combinations, each of which sends gas by pipeline to the central gas plant, from the seven well sites. The particular example shown in FIG. 6 recovers CNG, LPG and stabilized condensate in a deep cut facility at the central station. Each of these products is shipped to market by truck. For CNG, the gas is loaded directly into tanker trailers on a continuous basis. CNG trailers are available on site continuously as required so that flow is not interrupted. For LPG, FIG. 6 shows a stationary pressurized LPG tank on site which is pumped periodically into a propane tanker truck when the stationary tank on site is full. Alternatively, a propane trailer can be stationed on site at the central plant which takes the place of the stationary tank, provided that a trailer is on site continuously. When one propane tanker is full a second one is on site, already connected and ready to take on its cargo of LPG. For stabilized condensate, the anticipated production is probably very small, so a small atmospheric storage tank on site at the central plant is sufficient, to be pumped out on a weekly or bi weekly basis and trucked to market. All products leaving the central plant are metered before loading.

Equipment numbers applicable to FIG. 6 are the same as corresponding items of equipment in FIG. 2.

As an alternative to desiccant dehydration at the well-site, it may be practical to use glycol dehydration and use desiccant dehydration at the central plant.

Figure 7:
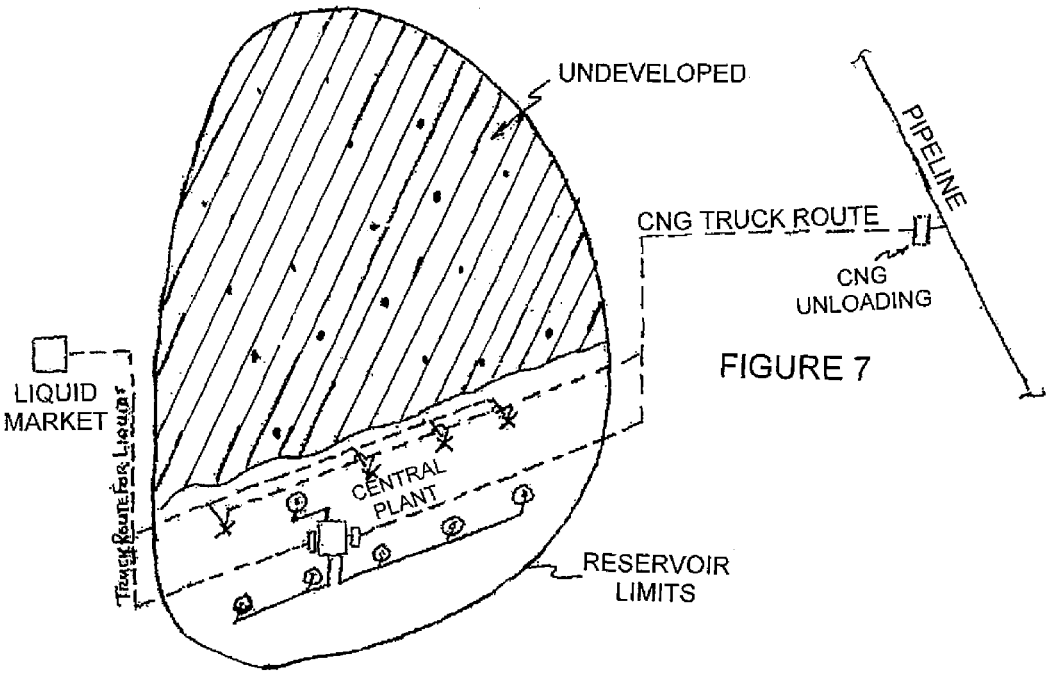
FIGS. 7, 8, 9 and 10 show plan views of four typical developments of gas fields.
Figure 8:
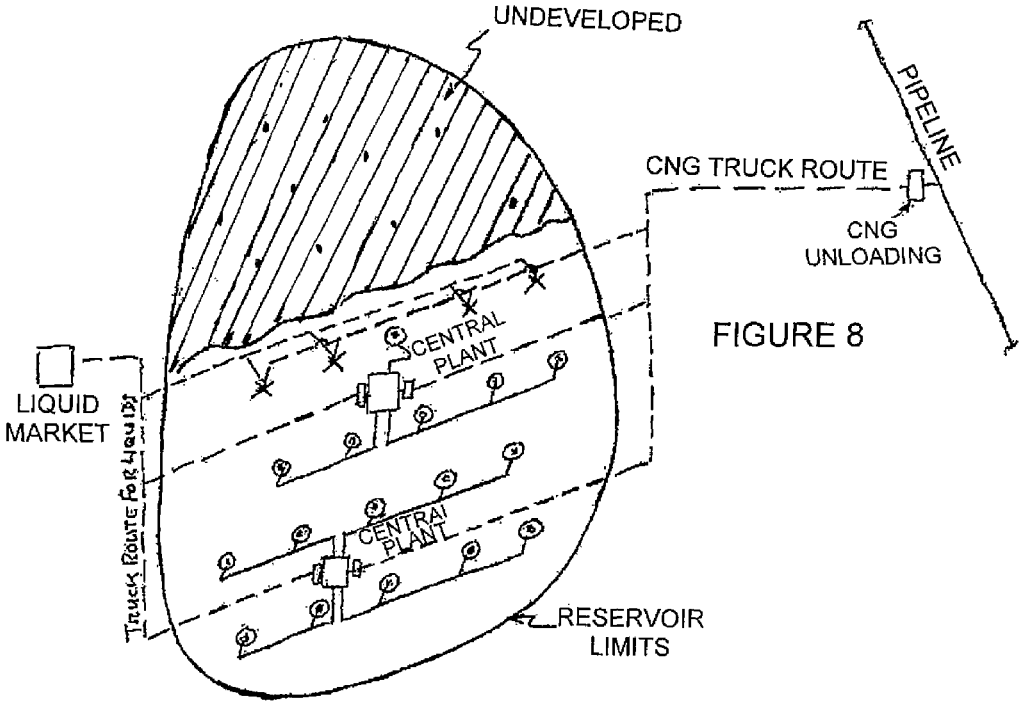
Figure 9:
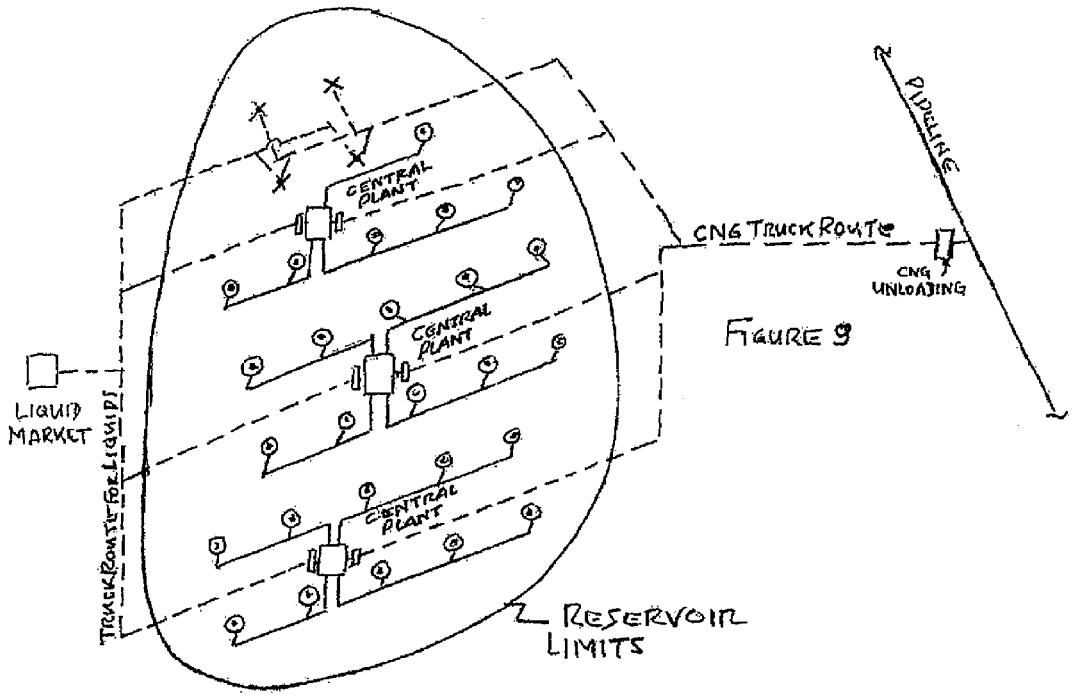
Figure 10:
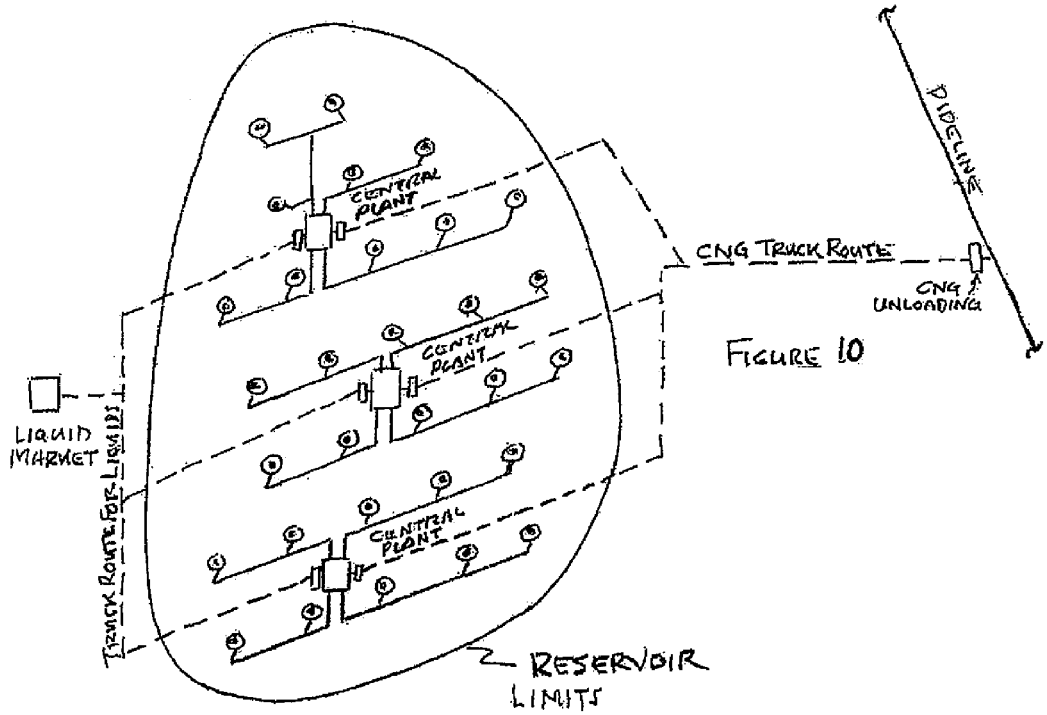

FIGS. 7, 8, 9, 10 show an arrangement for typical development of gas field where the four figures illustrate a typical case of the various stages in the development of a small gas field having a total of thirty marginal gas wells. FIG. 7 shows ten wells tied in, FIG. 8 shows twenty wells tied in, FIG. 9 shows all thirty wells tied in and in production but with the final four wells still in their initial high production phase. FIG. 10 shows the field fully developed with all thirty wells configured for long term low volume production. The three stage development in this particular example had ten wells per stage and three central plants serving ten wells each when the plan was complete.

The characteristics of this reservoir in the example are typical of many tight gas reservoirs, especially shale gas reservoirs, which have an initial flow which can be five times as much as their long term steady flow rate. Usually the deliverability tends to fall quite rapidly following the high production rate following startup. High flow for this type of well might be approximately 2.5 MMscfd which would decline over time to a stable flow of about 0.5 MMscfd which would then continue almost indefinitely. The figures in this example suggest a development plan for this type of field.

The development scheme for this field is to take advantage of the brief period of maximum production by installing portable self contained processing facilities which can handle the high flow period which on an individual well basis is complete and can produce CNG, LNG stabilized condensate, and possibly in some cases, ethane. This scheme enables the field to get into production quickly based on very few wells tied in and using miniature processing equipment to begin generating revenue right away from the sale of gas and liquids. The high flow facility at each well site is complete and self contained requiring only utilities from the power grid if available.

The scheme for this particular example calls for using four high capacity portable processing packages which are installed either one at a time or all four simultaneously in a tight cluster that can enable a planned expansion of a gathering system when the high capacity units are moved onto new wells to be replaced by low capacity compressor/dehydrator packages. The four high capacity units, each processing 2.5 MMscfd for a total of 10 MMscfd are moved step by step until all ten wells of the first ten well clusters are in production, four at high capacity and six at low capacity producing 0.5 MMSCFD each for an overall production of 13 MMscfd. As each set of four high volume units run down to 0.5 MMscfd, the portable high capacity units are moved on to new high volume wells to be replaced by miniature compressor/dehydrator combinations designed for 0.5 MMscfd each. Meanwhile, this central plant which uses a deep cut cryogenic process to produce CNG, LNG and Stabilized Condensate should be ready to accept the dry field gas from the low volume compressor/dehydrator units as soon as they are installed. Dry gas arrives at the central plant at about 500 psia.

Development proceeds in this way until the first cluster of ten wells is in production. FIG. 7 illustrates this, showing four high capacity wells and six low capacity wells which at this point are sending 3 MMscfd to the central plant which is designed for an ultimate capacity of 5 MMscfd when all ten wells are tied in to the plant. The four high capacity self contained units in FIG. 7 are processing 10 MMscfd in total and sending commercial products directly to market by truck. The central plant likewise sends commercial products to market by truck.

Among the things to consider in preparing a development plan is the location of the central plant among the cluster of wells. It should be placed so that the cost of the gathering system is minimized. The design and location of well stream metering equipment should also be considered if it is within the scope of the project. Reservoir engineers can recommend the sequence of developing new wells. For diagrammatic simplicity FIGS. 7 to 10 show development proceeding in an orderly way from south to north. Reservoir science, taking account of the delicate and sometimes temperamental nature of tight reservoirs may dictate otherwise.

FIG. 8 shows the first cluster of ten wells fully developed and tied in to the central plant. All ten wells of the second cluster are in production with four wells in high production mode and six wells in low production and tied in to control plant #2. As in FIG. 7, CNG, LNG, and stabilized condensate are delivered to market by truck. The example shows the CNG being unloaded into a pipeline; this probably requires a compressor to empty the truck. Delivery of CNG for industrial or domestic users may not require a compressor.

FIG. 9, like FIG. 8 shows the next stage of development with all thirty wells in production with the final four wells still in their high volume mode. Six wells are tied into the gathering system and are producing into central plant #3.

FIG. 10 shows the field fully developed with all 30 wells producing at 0.5 MMscfd each and tied in to their respective central plants.

This example illustrates the development of only one hypothetical field. The general principles are applicable to many fields but each case is different and the development plan should be specific to each situation.

FIGS. 11A to 11D show a number of arrangements for cooling CNG before it enters the tanks, assuming the truck tanks are considered empty at 165 psia and full at 3415 psia. Compression of gas into the tanks begins at 165 psia and ends at 3415 psia. As the tanks are filled, the gas already in the tanks increases in pressure and becomes warmer due to heat of compression. If the discharge cooler of the compressor cools the gas to 120° F. and if no further cooling occurs except convective cooling from the cool walls of the tank, the final average temperature in the tanks can be approximately 160° F. It is desirable to cool the gas further to increase the payload carried in the tanks. For example, if the temperature could be lowered by 30° F. the weight of gas carried in the tanks would increase by approximately 8%. Another issue to consider if composite materials are used in the tanks, excessive temperature can degrade the non metallic components in the tank, increasing possible risk of failure. As compression proceeds the gas initially in the tank is pushed to the far end of the tank and because this initial gas experiences the greatest change in pressure it also experiences the greatest increase in temperature. The far end of the tank becomes very hot while the inlet end remains cool. To prevent this misdistribution of temperature the inlet nozzle is connected to an inlet sparger that runs the full length of the tank to evenly distribute the gas as it enters the tank. This can produce an even, average, temperature rise for the full length of the tank, rather than one hot end and one cool end. The sparger runs along the bottom of the shell of the tank to act as a pickup duct for any liquid that may condense in the tank.

FIG. 11A shows an arrangement for Joule Thomson cooling from interstage where maintaining a back pressure on the interstage gas and choking it directly into the trucks' tanks produces a maximum temperature drop of about 50 to 60° F. for the gas initially flowing into the empty tank. This cooling effect can continue until the tank pressure equals interstage pressure. At that time the back pressure valve 135 is by passed and compressor 133 and cooler 134 start up and gas flowing into the tank can be constant at approximately 120° F. This system adds to horsepower hours to produce cooling.

FIG. 11B shows an arrangement for Joule Thomson cooling from discharge which uses Joule Thomson for cooling by maintaining a back pressure on the discharge gas entering the tank. The advantage of this system is that the back pressure setting is variable between interstage pressure and final pressure. As before, when tank pressure equals the back pressure, the choke is bypassed. Joule Thomson cooling adds to horse power hours to produce cooling.

FIG. 11C shows an arrangement for cooling CNG by external coolant where the discharge air cooler lowers the gas temperature to approximately 120° F., depending on ambient temperature. If an alternate coolant such as cooling water is available for exchanger (138) it possibly lowers the temperature by a further 40° F. Or, if refrigeration is used it lowers the inlet temperature sufficiently that that the final average temperature in the tanks can be about 120° F. The advantage of an external cooling is that it is constant throughout the filling cycle. Excessive cooling should be avoided however to avoid extreme cryogenic temperatures when the tanks are unloaded.

FIG. 11D shows an arrangement for cooling of recycle stream where instead of precooling the gas before it enters the tank so that when it undergoes compression inside the tank it is not too hot, an alternate approach is to recycle the gas in the tanks after it has become heated due to compression through a cooler 139 to remove the heat of compression directly. An external coolant such as ambient air or cooling water can be used. This cooled recycle gas is combined with inlet gas entering the tanks. A means to circulate the recycle gas should be used. Because pressure losses in the recycle circuit are very low, an educator (140) can be used to provide the motive power as shown in FIG. 11D. Recycle gas flow through the eductor should be positively controlled to avoid adding excessive loads to the compressor (133). Alternately a blower or compressor could be used in the circuit to recycle the cooled gas.

Figure 12:
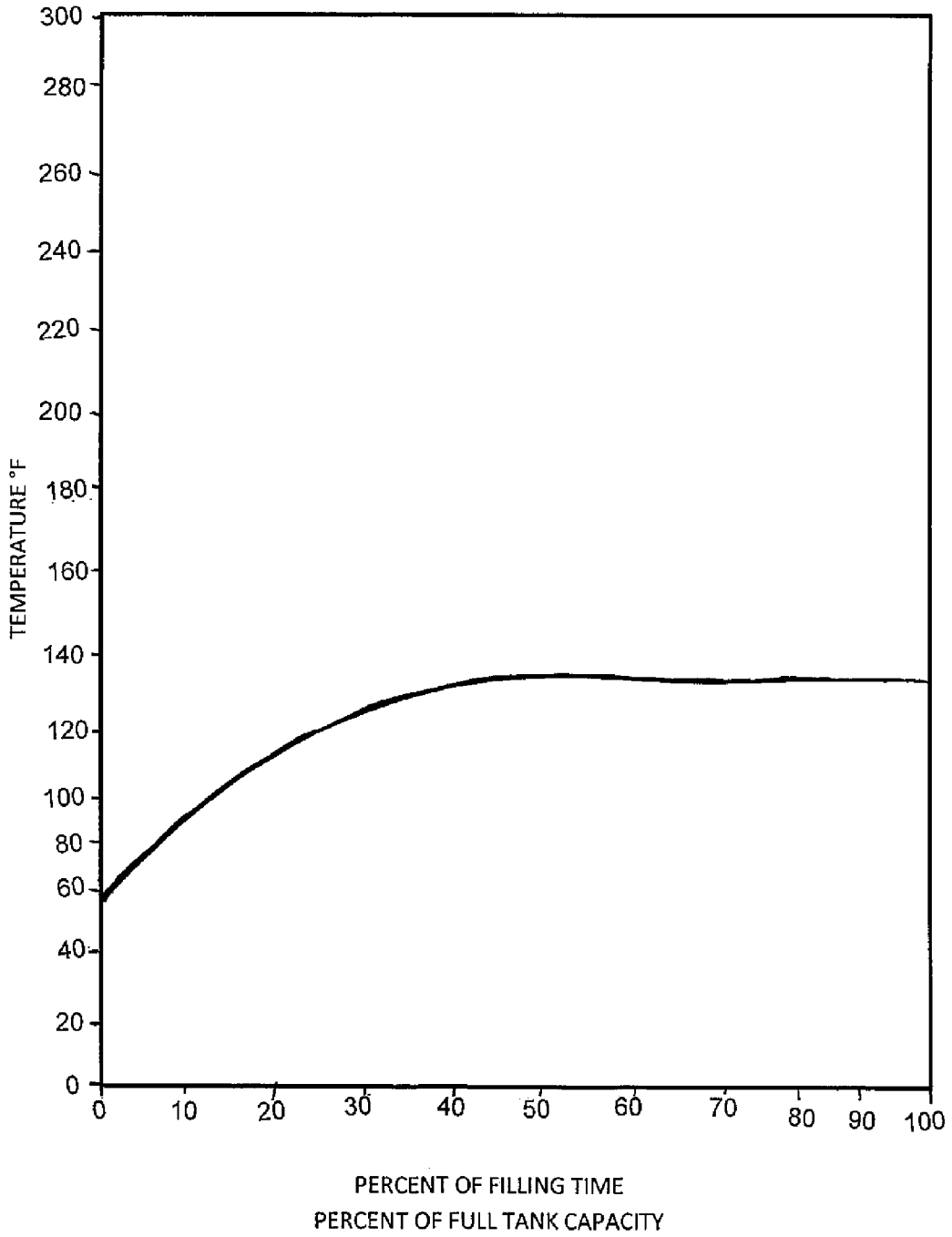
FIG. 12 is a graph showing the gas temperature profile related to the percentage filling of a tank capacity.

FIG. 12 shows the temperature profile during the filling phase of a tank: the choking effect of the back pressure valve on the final-stage compressor produces cooling. The cooling at the beginning of the fill cycle is sufficient to reduce the final average gas temperature to a desired level.

The invention claimed is:

1. A method of gas production from a field containing natural gas comprising:

extracting gas supply from a plurality of individual gas wells in the field;

in an initial process at the individual gas wells, providing a recovery unit having a production capacity arranged to approximate that of the well for carrying out liquid recovery from the gas supply and compression of natural gas from the gas supply;

and transporting the compressed natural gas produced in the initial process to a point of delivery;

and in a subsequent process, when a production rate of the well declines to a level which no longer approximates to that of the recovery unit:

removing the recovery unit for redeployment;

substituting the recovery unit by a dehydration system and gas compressors having a lower production capacity;

and transporting the compressed natural gas produced in the subsequent process to said point of delivery.

2. The method according to claim 1 wherein the compressed natural gas is transported at least in part using portable pressure vessels.

3. The method according to claim 2 wherein the gas from each gas well in the subsequent process is compressed, dehydrated and transported from the well by said portable pressure vessels to the point of delivery.

4. The method according to claim 2 wherein the portable pressure vessels are formed of fiber reinforced polymer.

5. The method according to claim 2 wherein a flow rate of the compressed natural gas supplied to the portable pressure vessels is continuous and at a steady rate.

6. The method according to claim 2 wherein the compressed natural gas supplied to the portable pressure vessels is dehydrated to a few PPM of water.

7. The method according to claim 6 wherein the compressed natural gas is dehydrated using a desiccant process using silica-gel or molecular sieve.

8. The method according to claim 2 wherein said transportation of compressed natural gas by the portable pressure vessels is continuous and related to the supply rate so as to avoid requirement on site for stationary high pressure gas storage.

9. The method according to claim 2 wherein the compressed natural gas is processed prior to transportation in said portable pressure vessels to remove small quantities of $H_2S$.

10. The method according to claim 2 wherein the compressed natural gas is processed prior to transportation in said portable pressure vessels to cool the gas.

11. The method according to claim 2 wherein the compressed natural gas is fed into said portable pressure vessels and distributed by an internal sparger running a full length of the vessel.

12. The method according to claim 11 wherein the sparger lays along a bottom of the vessel.

13. The method according to claim 1 wherein the compressed natural gas is transported using short pipelines to a central processing plant.

14. The method according to claim 1 wherein the initial recovery unit is redeployed to a different well with higher production rate.

15. The method according to claim 1 wherein in the initial process there is provided a liquid recovery unit and compressor at each well.

16. The method according to claim 15 wherein in the initial process the liquid recovery unit is arranged to process the raw gas into potentially commercial products right at the well using simple, small scale processing equipment.

17. The method according to claim 15 wherein in the initial process the liquid recovery unit and compressor are packaged into compact skid mounted units that are easily transportable by truck.

18. The method according to claim 1 wherein in the subsequent process the gas from a plurality of wells is transported to a central plant via pipelines and gas from the central plant is transported to the point of delivery.

19. The method according to claim 18 wherein the initial recovery unit is redeployed to the central plant for separating liquids therefrom.

20. The method according to claim 18 wherein the maximum number of gas wells feeding said central plant is about 10.

21. The method according to claim 19 wherein the initial recovery unit when redeployed to the central plant operates at the central plant in parallel with recovery units at other wells.

22. The method according to claim 18 wherein in the subsequent process the gas is transported from the plurality of wells to the central plant by pipe and the gas from the central plant is transported by said portable pressure vessels.

23. The method according to claim 18 wherein a distance between each of the plurality of wells and the point of delivery is below 100 miles.

24. The method according to claim 1 wherein flaring is reduced by liquid recovery at said recovery unit.

25. The method according to claim 1 wherein said point of delivery comprises a main gas pipeline.

26. The method according to claim 1 wherein in the initial process liquefied petroleum gas and stabilized condensates separated by the recovery unit are recombined with liquids from an oil battery or an upstream oil production separator.

* * * * *